US012453399B2

(12) United States Patent
Williams et al.

(10) Patent No.: US 12,453,399 B2
(45) Date of Patent: Oct. 28, 2025

(54) HANDHELD HAIR-STYLING TOOL FOR HAIR STYLING AND MANAGEMENT

(71) Applicant: MisTee Wants To Know, Inc., San Jose, CA (US)

(72) Inventors: Janice Williams, San Jose, CA (US); Kevin Rowett, San Jose, CA (US); Newton Paskin, San Jose, CA (US); Shmuel Silverman, Novato, CA (US)

( * ) Notice: Subject to any disclaimer, the term of this patent is extended or adjusted under 35 U.S.C. 154(b) by 92 days.

(21) Appl. No.: 17/945,095

(22) Filed: Sep. 15, 2022

(65) Prior Publication Data

US 2023/0087034 A1 Mar. 23, 2023

Related U.S. Application Data

(60) Provisional application No. 63/245,200, filed on Sep. 17, 2021.

(51) Int. Cl.

| | |
|---|---|
| ***A45D 2/36*** | (2006.01) |
| ***A45D 6/20*** | (2006.01) |
| ***A45D 19/16*** | (2006.01) |

(52) U.S. Cl.

CPC ..... *A45D 2/367* (2013.01); *A45D 6/20* (2013.01); *A45D 19/16* (2013.01)

(58) Field of Classification Search

CPC . A45D 2/36; A45D 2/00; A45D 2/002; A45D 19/16

See application file for complete search history.

(56) References Cited

U.S. PATENT DOCUMENTS

| | | | | |
|---|---|---|---|---|
| 4,121,602 | A | 10/1978 | Young | |
| 2010/0212179 | A1* | 8/2010 | Schmid | A45D 7/02 392/386 |
| 2012/0227758 | A1* | 9/2012 | Ford | A45D 2/001 132/229 |

(Continued)

FOREIGN PATENT DOCUMENTS

| | | | |
|---|---|---|---|
| WO | 2017045719 | A1 | 3/2017 |
| WO | 2020076339 | A1 | 4/2022 |

OTHER PUBLICATIONS

International Search Report and Written Opinion, PCT Appl. No. PCT/US2022/043726, Jan. 12, 2023.

*Primary Examiner* — Heidi M Eide
*Assistant Examiner* — Sydney J Pulvidente
(74) *Attorney, Agent, or Firm* — Steve Stupp

(57) ABSTRACT

A hair-styling tool may include one or more pods that store liquid. For example, the hair-styling tool may include a removable, reusable water pod and/or a removable oil-formulation pod, which may correspond to a hair type of an individual. Moreover, during operation, the hair-styling tool may output or provide one or more discharges, such as: a steam discharge, an oil-formulation discharge, and/or a steam-and-oil-formulation discharge. The discharge flow may be selectable or dynamically adjusted based at least in part on the hair type of the individual, a predefined preference of the individual, and/or a predefined preference of a hair stylist. Moreover, the one or more discharges may be output of or provided from a head in the hair-styling tool. This head may include multiple prongs or tines that are used, in conjunction with the one or more discharges, to detangle or style an individual's hair.

13 Claims, 8 Drawing Sheets

(56) References Cited

U.S. PATENT DOCUMENTS

| | | | | |
|---|---|---|---|---|
| 2015/0342515 | A1 | 12/2015 | Withings | |
| 2017/0135457 | A1 | 5/2017 | Ngo et al. | |
| 2019/0350334 | A1 | 11/2019 | Montagnino | |
| 2019/0350346 | A1* | 11/2019 | Samain ..... | A45D 19/0041 |

* cited by examiner

HANDHELD HAIR-STYLING TOOL FOR HAIR STYLING AND MANAGEMENT

CROSS REFERENCE TO RELATED APPLICATIONS

This application claims priority under 35 U.S.C. 119(e) to U.S. Provisional Application Ser. No. 63/245,200, "Handheld Hair-Styling Tool for Hair Styling and Management," filed on Sep. 17, 2021, by Janice Williams, et al., the contents of which are herein incorporated by reference.

FIELD

The disclosed embodiments relate to hair-styling techniques. Notably, the disclosed embodiments relate to a handheld hair-styling tool that outputs steam and/or oil for hair styling and management.

BACKGROUND

Because of protective styles (such as braiding, extensions, lace front wigs, wigs, etc.) and chemicals (such as blond coloring, lighteners, relaxers, etc.), current styling techniques typically put hair strands and the scalp in a compromised physical state. Consequently, many men and women are avoiding straightening their hair. Instead, they wear their hair naturally, in a curly or textured manner. These hair-style choices, however, pose tangling challenges for stylists and consumers.

SUMMARY

A hair-styling tool is described. This hair-styling tool includes: a first pod that stores a first liquid; a pump that transfers the first liquid from the first pod to a heater; the heater that converts the first liquid to a first gas, and outputs the first gas from openings in the hair-styling tool; one or more sensors that monitor the heating and/or the output of the first gas; and a controller that controls operation of the hair-styling tool based at least in part on a hair type of an individual and a type of the first liquid.

Note that the first pod may be coupled to the hair-styling tool.

Moreover, the first liquid may include: water and/or an oil formulation.

Furthermore, the first liquid may include an oil formulation in a set of predefined oil formulations and the oil formulation may correspond to the hair type.

Additionally, the controller may control operation of the hair-styling tool based at least in part on an issue associated with hair of the individual.

In some embodiments, the controller may control operation of the hair-styling tool based at least in part on a flow setting of the hair-styling tool.

Moreover, the controller may control operation of the hair-styling tool based at least in part on a predefined preference of the individual and/or a hair stylist.

Furthermore, the controller may include a processor.

Additionally, the one or more sensors may include: a hardware sensor and/or a software sensor (such as a sensor that is implemented using software or program instructions that is executed by the processor).

In some embodiments, the hair-styling tool may include an interface circuit that wirelessly communicates with an electronic device, and the hair-styling tool may: provide, addressed to the electronic device, data associated with operation of the hair-styling tool; and receive, associated with the electronic device, an update to a capability of the hair-styling tool or an additional capability of the hair-styling tool or information that specifies a modification to operation of the hair-styling tool. Note that the hair-styling tool may receive, associated with the electronic device, information specifying the hair type.

Moreover, the one or more sensors may include an environmental-monitoring sensor that determines an environmental condition in an environment of the hair-styling tool, and the controller may control operation of the hair-styling tool based at least in part on determined environmental conditions. Note that the environmental condition may include: temperature and/or humidity.

Furthermore, the hair-styling tool may include a head, remateably coupled to the hair-styling tool, that includes multiple tines or prongs corresponding to the hair type and second openings coupled to the openings, where the second openings are spatially proximate to the tines or prongs.

Additionally, the hair-styling tool may include: a second pod that to stores a second liquid (which may be different from the first liquid); and a switch that selectively couples the first pod and/or the second pod to the pump. When selectively coupled to the first pod and/or the second pod, the pump may transfer the first liquid from the first pod to the heater and/or the second liquid from the second pod to the heater. Moreover, the heater may convert the first liquid to the first gas and to output the first gas from openings in the hair-styling tool, and/or may convert the second liquid to the second gas and to output the second gas from the openings in the hair-styling tool. Furthermore, the one or more sensors may monitor one or more of: the heating, the output of the first gas, and/or the output of the second gas. Note that the controller may control operation of the hair-styling tool based at least in part on the hair type of the individual and the type of the first liquid and/or a type of the second liquid. In some embodiments, the first pod and/or the second pod is remateably coupled to the hair-styling tool.

Moreover, controlling operation of the hair-styling tool may include selecting a set of operating parameters associated with thermal management of the heater.

Another embodiment provides a computer-readable storage medium for use with the hair-styling tool. This computer-readable storage medium may include program instructions that, when executed by the hair-styling tool, cause the hair-styling tool to perform at least some of the aforementioned operations.

Another embodiment provides a method. This method includes at least some of the operations performed by the hair-styling tool.

This Summary is provided for purposes of illustrating some exemplary embodiments, so as to provide a basic understanding of some aspects of the subject matter described herein. Accordingly, it will be appreciated that the above-described features are examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE FIGURES

Note that like reference numerals refer to corresponding parts throughout the drawings. Moreover, multiple instances of the same part are designated by a common prefix separated from an instance number by a dash.

DETAILED DESCRIPTION

Figure 1:
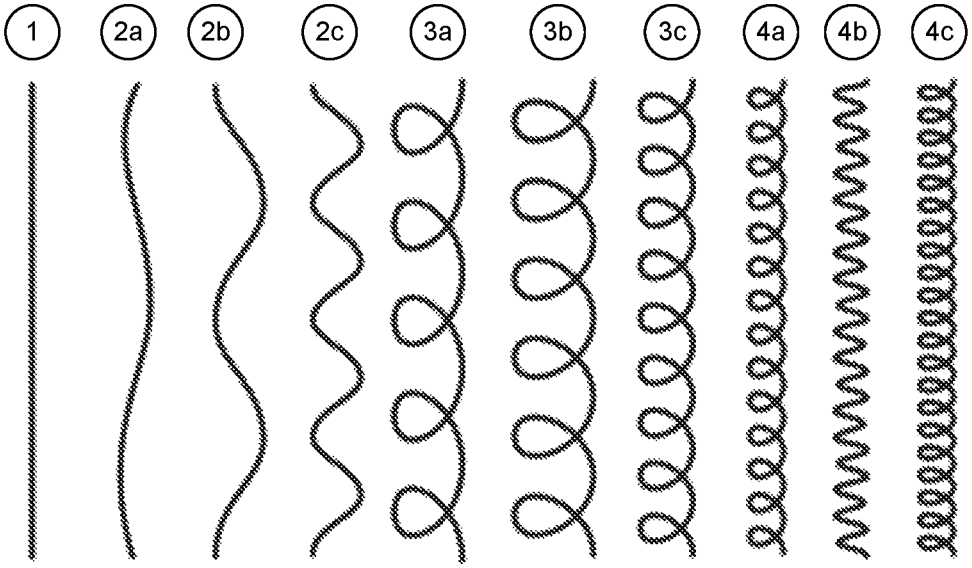
FIG. 1 is a drawing illustrating examples of different hair types in accordance with an embodiment of the present disclosure.

A hair-styling tool may include one or more pods that store liquid. For example, the hair-styling tool may include a removable, reusable water pod and/or a removable oil-formulation pod, which may correspond to a hair type of an individual. Moreover, during operation, the hair-styling tool may output or provide one or more discharges, such as: a steam discharge, an oil-formulation discharge, and/or a steam-and-oil-formulation discharge. The discharge flow may be selectable or dynamically adjusted based at least in part on the hair type of the individual, a predefined preference of the individual, and/or a predefined preference of a hair stylist. Moreover, the one or more discharges may be output of or provided from a head in the hair-styling tool. This head may include multiple prongs or tines that are used, in conjunction with the one or more discharges, to detangle or style an individual's hair.

By leveraging oil and/or steam to provide an oil-steam discharge (which is sometimes referred to as an 'oily steam'), the hair-styling techniques may soften and elongate hair, thereby loosening and detangling knots and tangles, and addressing hair frizzing. Moreover, the oil-steam discharge in the hair-styling techniques may provide advantages for stylists and address the damage and the problems that people are having with their hair. Furthermore, the hair-styling techniques may provide an 'advanced hair therapy' because the particle sizes in the oil-steam discharge may be able to penetrate deep into the hair (e.g., to its deepest layer). For example, the extra fineness of the oil-steam discharge particles and the size and shape of the holes in the base of the tool may allow the oil-steam discharge to more easily spread from the hair root to the tip. Consequently, the hair-styling techniques may improve hair management, thereby reducing cost and effort by hair stylists, and improving customer satisfaction with their hair and its styling.

In some embodiments, the hair-styling tool may use pods containing oil and/or water that may address: tangled, knotty hair, scalp care, silk press, natural/textured hair styling and maintenance/care, color treated/bleached hair, and/or conditioners. Moreover, the hair-styling tool may optionally discharge or provide: steam only (e.g., from a reusable water pod); an oil formulation (e.g., from an oil and water formulation pod), and/or a combination of an oil formulation and additional steam (e.g., from an oil formulation pod and a reusable water pod). Thus, an integrated system may include a hair-styling tool (which may be a handheld device) that discharges steam only or a combination of oil and steam.

Note that steaming tools for conditioning and/or straightening of hair can be defined by two categories: hooded, or handheld devices. Hooded devices are generally used along with liquid conditioners to condition hair after a wash and work by discharging tiny water particles. Alternatively, handheld steamers are usually directed towards straightening hair. However, some handheld steamers have been designed to detangle hair.

In general, steam adds moisture without removing natural oils and helps to hydrate and define natural hair. The hair detangling process generally occurs before washing of hair, where it adds moisture, restores color vibrancy, strengthens hair elasticity, removes tangles, and elongates the hair itself. Moreover, the use of oil may allow for easier detangling, while also providing nutrients and softeners to the hair.

As illustrated in FIG. 1, which presents a drawing illustrating examples of different hair types, there are multiple different hair types. Each hair type varies in structure and texture and requires different types of maintenance, styling, and products. In many cases, a person can have more than one hair type growing out of their scalp.

As shown in FIG. 1, straight hair (type 1) is one of the most resilient of all the hair types. This hair type can be challenging to damage and/or curl, and is the most oily hair texture of all because the natural scalp oil (sebum) can easily make its way to the hair ends without the interference of curls or kinks.

Moreover, wavy hair lies (type 2) is between straight and curly hair. There are several varieties: type 2A, type 2B, and type 2C. Type 2B can have straight strands at the root and form waves toward the middle of the hair shaft. The further down the wavy spectrum, the more the hair is prone to frizz. Consequently, types 2B and 2C are typically more challenging to style.

Furthermore, curly hair falls (type 3) has, in general, an S shape or, on some occasions, a Z shape. This hair type has several varieties: type 3A, type 3B, and type 3C. Curly hair is full-bodied, climate-dependent (e.g., humidity results in frizz) and damage-prone. Type 3A curls are well-defined with a spiral or ringlet shape. Type 3B hair has a springy, voluminous texture and the strands have a smaller width, which gives the mane a fuller appearance. Type 3C hair looks like tight corkscrews. Curly hair is the most temperamental hair type if you apply too much styling product. In order to provide reduced or effortless, frizz-free curls, proper styling product application is often needed.

Additionally, type 4 is kinky hair. This hair type also has several varieties: type 4A, type 4B, and type 4C. In spite of many misconceptions, this tightly coiled hair is usually quite fine and fragile. The hair is often wiry and delicate by nature, with each strand having a zig-zag like pattern. Kinky hair is also the driest, which makes it more prone to hair breakage. While type 4 hair grows at the same rate as other textures, the occurrence of breakage is more prevalent and, therefore, makes this type of hair more challenging for lengthening.

Because kinky hair is drier by nature, and therefore breaks easily, it typically requires more moisture to allow for increased elasticity.

Figure 2:
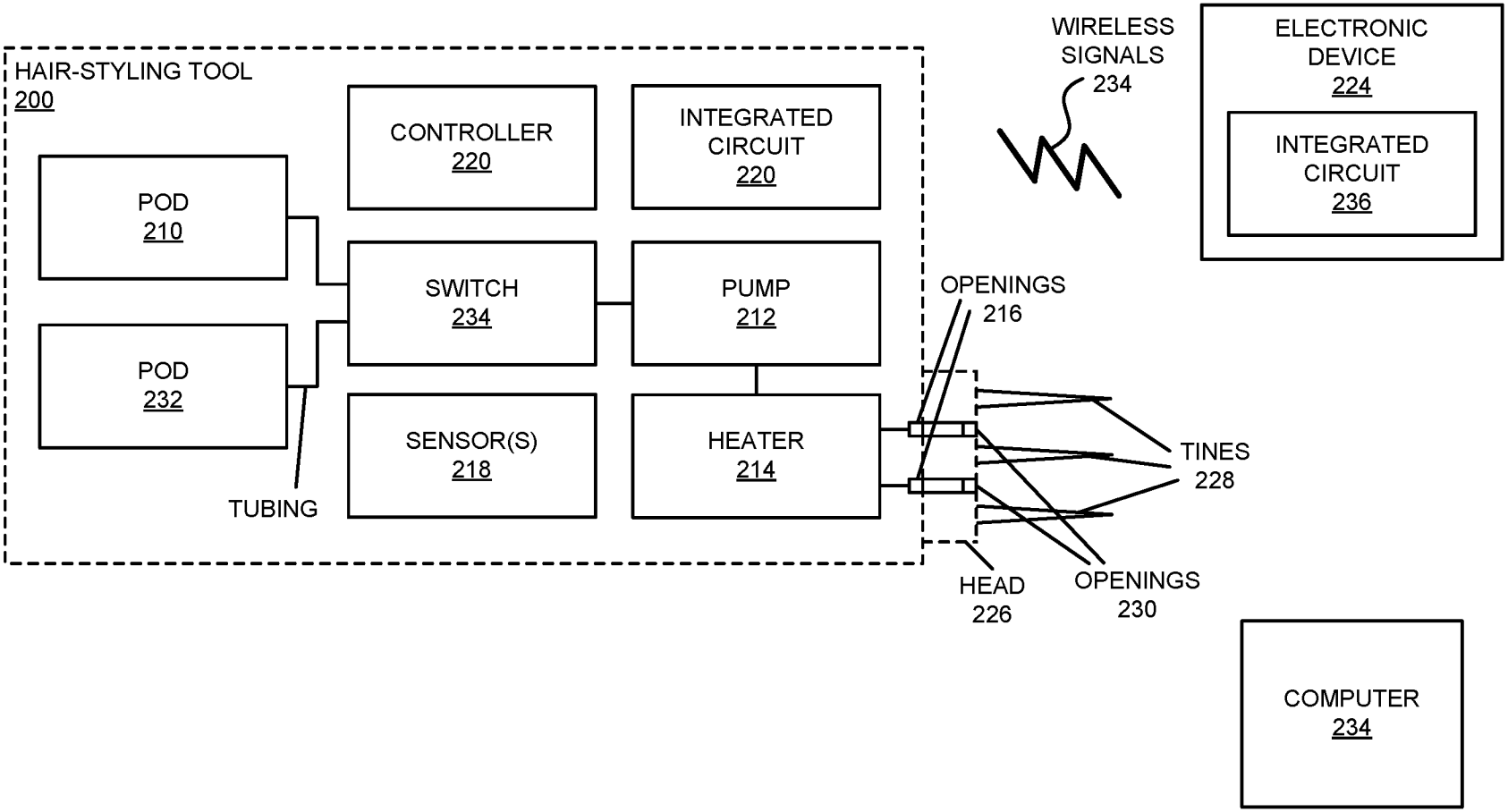
FIG. 2 is a block diagram illustrating an example of a hair-styling tool in accordance with an embodiment of the present disclosure.

We now further describe the hair-styling techniques. FIG. 2 presents a block diagram illustrating an example of a hair-styling tool 200. This hair-styling tool may include: a pod 210 that stores a first liquid (such as water and/or an oil formulation); a pump 212 that transfers the first liquid from pod 210 to a heater 214; heater 214 that converts the first liquid to a first gas, and outputs the first gas from openings 216 in hair-styling tool 200; one or more sensors 218 that monitor the heating and/or the output of the first gas; and a controller 220 (such as a processor) that controls operation of hair-styling tool 200 based at least in part on a hair type of an individual and a type of the first liquid.

Note that pod 210 may be coupled to hair-styling tool 200.

Moreover, the first liquid may include an oil formulation in a set of predefined oil formulations and the oil formulation may correspond to the hair type. For example, the oil formulation may be selected based at least in part on the hair type. Alternatively or additionally, a combination or mixture of water and/or the oil formulation may be selected based at least in part on the hair type.

Furthermore, controller 220 may control operation of hair-styling tool 200 based at least in part on an issue associated with hair of the individual. Additionally, controller 220 may control operation of hair-styling tool 200 based at least in part on a flow setting of the hair-styling tool. In some embodiments, controller 220 may control operation of hair-styling tool 200 based at least in part on a predefined preference of the individual and/or a hair stylist. Note that controlling operation of hair-styling tool 200 may include selecting a set of operating parameters associated with thermal management of heater 214.

Additionally, the one or more sensors 218 may include: a hardware sensor and/or a software sensor (such as a sensor that is implemented using software or program instructions that is executed by the processor). For example, the one or more sensors 218 may include an environmental-monitoring sensor that determines an environmental condition (such as temperature and/or humidity) in an environment of hair-styling tool 200, and controller 220 may control operation of hair-styling tool 200 based at least in part on determined environmental conditions.

In some embodiments, hair-styling tool 200 may include an interface circuit 220 (such as a radio) that wirelessly communicates with an electronic device 224 (such as a cellular-telephone, a computer, a tablet, a smartwatch, a portable electronic device, etc.). Moreover, hair-styling tool 200 may: provide, addressed to electronic device 224, data associated with operation of hair-styling tool 200; and receive, associated with electronic device 224, an update to a capability of hair-styling tool 200, an additional capability of hair-styling tool 200 or information that specifies a modification to operation of hair-styling tool 200 (such as a change to one or more operating parameters). Note that hair-styling tool 200 may receive, associated with electronic device 224, information specifying the hair type. For example, a hair stylist may interact with a user interface in electronic device 224 (such as using a touch-sensitive display, a keyboard, a mouse, a stylus, a trackpad, a voice-recognition interface, or another type of human-interface device) to provide, select or specify the capability, the additional capability and/or the hair type, which is then communicated wirelessly to hair-styling tool 200.

Note that electronic device 224 may provide information about operation of hair-styling tool to computer 238 (such as to a cloud-based computer via a network, such as the Internet and/or a cellular-telephone network). Computer 238 may aggregate and/or analyze information from multiple instances of hair-styling tool 200, and may disseminate recommendations or lessons learned (such as operating parameters for hair-styling tool 200, an oil type to use with a particular hair type, etc.) to, e.g., electronic device 224, which may provide the recommendations or lessons learned to hair-styling tool 200.

Moreover, hair-styling tool 200 may include a head 226, remateably coupled to hair-styling tool 200, that includes multiple tines 228 or prongs corresponding to the hair type and openings 230 coupled to openings 216, where openings 230 are spatially proximate (e.g., adjacent to) to tines 228 or prongs.

Furthermore, hair-styling tool 200 may include: an optional pod 232 that to stores a second liquid (which may be different from the first liquid); and/or an optional switch 234 (such as one or more mechanical valves) that selectively couples pod 210 and/or pod 232 to pump 212. When selectively coupled to pod 210 and/or pod 232, pump 212 may transfer the first liquid from pod 210 to heater 214 and/or the second liquid from pod 232 to heater 214. Moreover, heater 214 may convert the first liquid to the first gas and to output the first gas from openings 216 in hair-styling tool 200, and/or may convert the second liquid to the second gas and to output the second gas from openings 216 in hair-styling tool 200. Furthermore, the one or more sensors 218 may monitor one or more of: the heating, the output of the first gas, and/or the output of the second gas. Note that controller 220 may control operation of hair-styling tool 200 based at least in part on the hair type of the individual and the type of the first liquid and/or a type of the second liquid. In some embodiments, pod 210 and/or pod 232 is remateably coupled to hair-styling tool 200.

In general, wireless communication with hair-styling tool 200 tool may be bidirectional. As can be seen in FIG. 2, wireless signals 234 (represented by a jagged line) may be transmitted by integrated circuit 220. For example, integrated circuit 220 may transmit information (such as one or more packets or frames) using wireless signals 234. These wireless signals are received by integrated circuit 236 in electronic device 224. This may allow hair-styling tool 200 to communicate information to electronic device 224 or vice versa. Note that wireless signals 234 may convey one or more packets or frames.

In the described embodiments, processing a packet or a frame in hair-styling tool 200 or electronic device 224 may include: receiving the wireless signals with the packet or the frame; decoding/extracting the packet or the frame from the received wireless signals to acquire the packet or the frame; and processing the packet or the frame to determine information contained in the payload of the packet or the frame.

Note that the wireless communication in FIG. 2 may be characterized by a variety of performance metrics, such as: a data rate for successful communication (which is sometimes referred to as 'throughput'), an error rate (such as a retry or resend rate), a mean-squared error of equalized signals relative to an equalization target, intersymbol interference, multipath interference, a signal-to-noise ratio, a width of an eye pattern, a ratio of number of bytes successfully communicated during a time interval (such as 1-10 s) to an estimated maximum number of bytes that can be communicated in the time interval (the latter of which is sometimes referred to as the 'capacity' of a communication channel or link), and/or a ratio of an actual data rate to an estimated data rate (which is sometimes referred to as 'utilization'). Note that the integrated circuit 220 and 236 shown in components in FIG. 2 may be the same as or different from each other.

In some embodiments, hair-styling tool 200 and/or electronic device 224 communicate packets or frames in accordance with a wireless communication protocol, such as: a wireless communication protocol that is compatible with an IEEE 802.11 standard (which is sometimes referred to as 'Wi-Fi®,' from the Wi-Fi Alliance of Austin, Texas), Bluetooth, a cellular-telephone network or data network communication protocol (such as a third generation or 3G communication protocol, a fourth generation or 4G communication protocol, e.g., Long Term Evolution or LTE (from the 3rd Generation Partnership Project of Sophia Antipolis, Valbonne, France), LTE Advanced or LTE-A, a fifth generation or 5G communication protocol, or other present or future developed advanced cellular communication protocol), and/or another type of wireless interface (such as another wireless-local-area-network interface). For example, an IEEE 802.11 standard may include one or more of: IEEE 802.11a, IEEE 802.11b, IEEE 802.11g, IEEE 802.11-2007, IEEE 802.11n, IEEE 802.11-2012, IEEE 802.11-2016, IEEE 802.11ac, IEEE 802.11ax, IEEE 802.11ba, IEEE 802.11be, or other present or future developed IEEE 802.11 technologies. However, a wide variety of communication protocols may be used, including wired and/or wireless communication.

Moreover, wireless communication between components in FIG. 2 may use one or more bands of frequencies, such as: 900 MHz, 2.4 GHz, 5 GHz, 6 GHz, 60 GHz, the Citizens Broadband Radio Spectrum or CBRS (e.g., a frequency band near 3.5 GHz), and/or a band of frequencies used by LTE or another cellular-telephone communication protocol or a data communication protocol. Furthermore, note that the communication between electronic devices may use multi-user transmission (such as orthogonal frequency division multiple access or OFDMA) or multiple-input multiple-output (MIMO).

Although we describe the environment shown in FIG. 2 as an example, in alternative embodiments, different numbers or types of electronic devices may be present. For example, some embodiments comprise more or fewer electronic devices. As another example, in another embodiment, different electronic devices are transmitting and/or receiving wireless signals.

In some embodiments, hair-styling tool 200 may include fewer or more components, two or more components may be combined into a single component, a second single component may be implemented using multiple components, and/or a position of at least one of the components may be changed.

Figure 3:
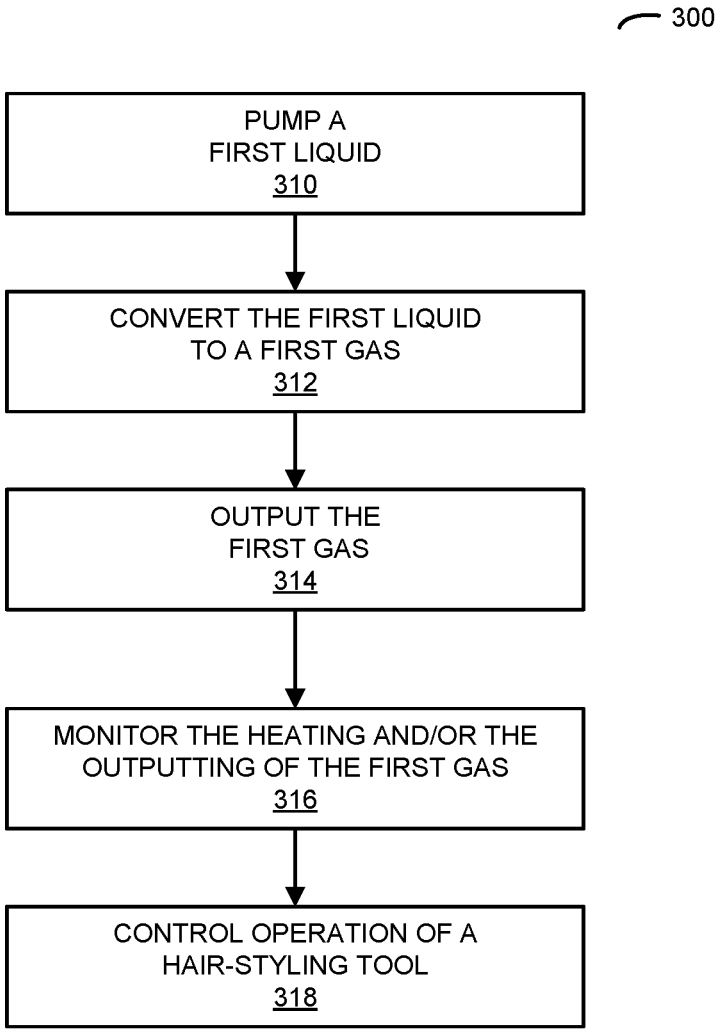
FIG. 3 is a flow diagram illustrating an example method for operating the hair-styling tool in FIG. 2 in accordance with an embodiment of the present disclosure.

We now describe embodiments of the method. FIG. 3 presents a flow diagram illustrating an example of a method 300 for operating a hair-styling tool, such as hair-styling tool 200 (FIG. 2). During operation, the hair-styling tool may pump a first liquid (operation 310) from a first pod in the hair-styling tool to a heater in the hair-styling tool. Then, the hair-styling tool may convert, using the heater, the first liquid to a first gas (operation 312). Moreover, the hair-styling tool may output the first gas (operation 314) from openings in the hair-styling tool. Next, the hair-styling tool may monitor, using one or more sensors in in the hair-styling tool, the heating, the outputting of the first gas, or both (operation 316). Furthermore, the hair-styling tool may control operation of the hair-styling tool (operation 318) based at least in part on a hair type of an individual and a type of the first liquid.

In some embodiments, method 300 may include additional or fewer operations. Moreover, the order of the operations may be changed, there may be different operations, two or more operations may be combined into a single operation, and/or a single operation may be divided into two or more operations.

Figure 4:
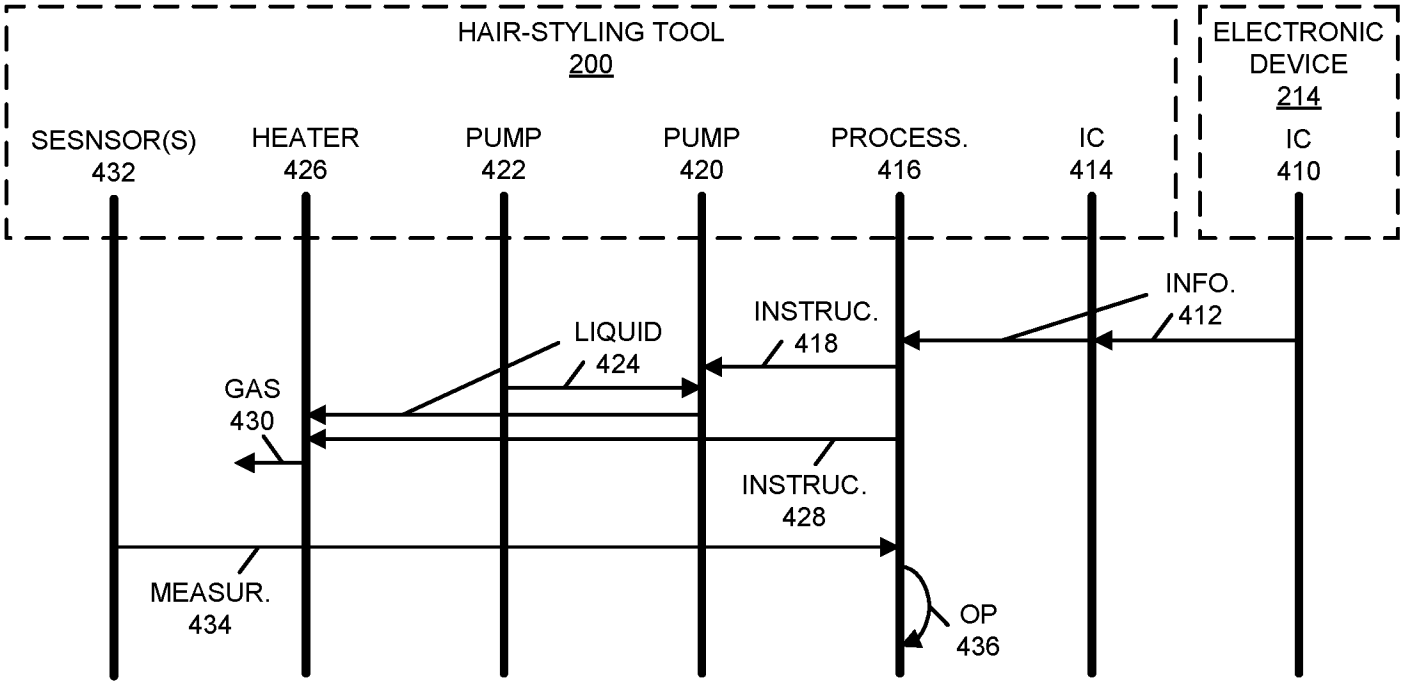
FIG. 4 is a drawing illustrating an example of communication between a hair-styling tool and an electronic device in FIG. 2 in accordance with an embodiment of the present disclosure.

Embodiments of the hair-styling techniques are further illustrated in FIG. 4, which presents a drawing illustrating an example of communication between hair-styling tool 200 and electronic device 224. Notably, an interface circuit (IC) 410 in electronic device 224 may transmit information 412 specifying: operating parameters (OP) 436 of hair-styling tool 200, one or more preferences of an individual or a hair stylist, a hair type, a water and/or oil formulation, an oil type, etc. After receiving information 412, an interface circuit 414 in hair-styling tool 200 may provide information 412 to a processor 416 in hair-styling tool 200.

Then, during operation, processor 416 may control operation of hair-styling tool 200 based at least in part on information 412. Notably, processor 416 may provide an instruction 418 (or a control signal) to pump 420 in hair-styling tool 200, which may pump a liquid 424 from pod 422 in hair-styling tool 200 to a heater 426 in hair-styling tool 200. Then, processor 416 may provide an instruction 428 (or a control signal) to heater 426 to convert liquid 424 to gas 430 (e.g., based at least in part on thermal-management parameters, which may be directly or indirectly specified by the operating parameters). This gas may be output from openings in hair-styling tool 200. Moreover, one or more sensors 432 in in hair-styling tool 200 may monitor the heating by heater 426 and/or the outputting of gas 430, and may provide measurements 434 to processor 416. Next, processor 416 may update operating parameters 436 of hair-styling tool 200 based at least in part on measurements 434.

While FIG. 4 illustrates communication between components using unidirectional or bidirectional communication with lines having single arrows or double arrows, in general the communication in a given operation in this figure may involve unidirectional or bidirectional communication. Moreover, while FIG. 4 illustrates operations being performed sequentially or at different times, in other embodiments at least some of these operations may, at least in part, be performed concurrently or in parallel.

We now further describe the hair-styling techniques. Two large benefits of the hair-styling techniques are the ability to detangle with ease and to limit hair breakage. Notably, the steam and oil discharge add moisture to hair and allows for stylists and consumers to more quickly and effectively remove knots from hair. An alternative approach for using the hair-styling tool is manual combing. However, this approach is often time-consuming and can cause hair breakage. Additionally, while the hair-styling tool provides detangling, it also enables a way to elongate and freshen hair midweek without requiring another hair wash.

Moreover, the benefits of using steam include the steam lifting the cuticle on the hair shaft, which allows conditioners and treatments to penetrate each hair strand. Furthermore, the heat from the steam may help break down build up caused by hair products, such as hair sprays, gels, and/or similar products. The steam discharged may be powerful enough to break up product built-up without drying out the hair and/or scalp. Once the impurities/products are removed, an individual can easily rinse their hair leaving it feeling cleaner than ever. Additionally, steaming hair allows the consumer or stylist to style hair easily with reduced or without any worries of hair breakage (in contrast with brushing, e.g., using a comb or fingers, in existing techniques). This may be accomplished by the steam and oil formulation output, which may help hair feel more elastic while nourishing it. The steam discharge (with or without oil) may allow moisture to penetrate deep into the hair shaft. These functions and uses for steam may reduce the chance of brittle hair, which is more prone to breakage. Note that hair usually grows better when it is properly moisturized and when it does not break easily. Steam moisturizes hair from the inside and the hair is more likely to better retain the moisture. The moist heat from the steam may also encourage blood flow to the scalp. This additional scalp circulation may result in healthier hair. Steaming may also help women who are transitioning from chemically relaxed to natural hair, because it can soften the demarcation where the straight portion ends and the curls begin.

The disclosed hair-styling techniques may effectively and efficiently detangle knots in hair. Typically, the detangling process is time-consuming and challenging using existing techniques. Existing techniques may also reduce the number of clients a hair stylist can see per week, which has a direct impact on their revenue.

While the majority of handheld steamers are for straightening hair, there have been handheld steamers designed to detangle textured hair. However, most manual detangling approaches are time-consuming. For example, manual detangling techniques may include using fingers to pry knots and tangles apart or using a comb or brush (which often results in hair breakage). Type 3 and type 4 hair are very prone to breakage, because the oil from the scalp does not go down the hair shaft as easily when the hair is curly (as opposed to straight hair).

As noted previously, a comb is frequently used to detangle hair and, because it is not taught in cosmetology schools, many stylists do not know the proper technique to use a comb to detangle. This lack of knowledge contributes to excessive hair breakage and a time-consuming process. While there are detangling brushes, their usage can also result in excessive hair breakage and often take hours to detangle the entire head.

When hair is compromised or tangled, the hair-strand cuticles are raised. This can create a framework for more knots and tangles, because the hair can easily come together and cannot be easily separated. Oil makes the cuticle layer go flat (or reseals it) and feel smoother. The steam and oil formulation in the disclosed hair-styling techniques optionally combined with the hair-styling tool address detangling, smoothing the hair, and hydrating and moisturizing.

The disclosed hair-styling techniques combine water and/or oil to make an oily steam, which absorbs deep into the hair shaft, elongates and lubricates the hair to reduce excessive hair breakage and decrease the time spent detangling. The hair-styling tool provides a way to customize the steaming experience, allowing users (such as an individual or a consumer, or a professional user, such as a hair stylist) to regulate the amount of steam and/or oil that is used/discharged. The output volume (the amount of steam/oil being released per unit time) can be regulated using a knob or button on the hair-styling tool, such as for low, medium and high. The hair-styling tool may also allow the regulation or adjustment of the steam, including the temperature and output flow.

The hair-styling tool may be used by textured/natural-hair and weave stylists and/or consumers to tackle the problem of or to manage knotty hair. The hair-styling tool may leverage steam and/or oil, and may include prongs (or tines) to detangle hair faster and more effectively. Additionally, the hair-styling tool may use a proprietary pod filled oil that can be discharged based at least in part on the preference of the user or hair stylist.

The hair-styling tool may have the ability to discharge steam using water alone or to discharge a water-and-oil formulation. When this combination is used on hair, it may penetrate deep into the hair shaft, thereby allowing the hair stylist and/or the user to gently and effectively untangle hair without pulling out lots of hair (or hair loss).

In some embodiments, the hair-styling tool may include embedded software or firmware. Thus, in general, functions of the hair-styling tool may be implemented in hardware and/or software. For example, software may be used to implement: data collection, oil-pod authentication, over-the-air communication or tool issues and/or updates, tampering protection, temperature control, functional measurements, etc.

In the present discussion, note that the pod types used with the hair-styling tool may include: a reusable water pod (for water only); and/or an oil-formulation pod that includes a premixed oil-and-water formulation. Note that there may be different oil-formulation pods with different mixtures or oil and/or water concentrations for different types of hair.

Moreover, in the present discussion, for the discharge steam, 'steam' may refer to water only, while 'oily steam' may refer to the steam discharged from the hair-styling tool when using an oil-formulation pod. Thus, oily steam may refer to the combination of oil and water.

Referring back to FIG. 2, handheld hair-styling tool 200 or device may have several embodiments with different orientations and/or designs. In general, there may be two types of hair-styling tools, which each may have multiple hair-styling tool designs or embodiments (as described further below). The two hair-styling tool types may be integrated into or included in any of the embodiments.

Notably, the two types of hair-styling tools may include: a single-pod implementation, and a multi-pod implementation (such as a double-pod implementation). The single-pod implementation may include: a reusable water pod or an oil-formulation pod; and flow control of the discharge or output (such as low, medium or high output flow). Moreover, a double-pod implementation may include: a reusable water pod; an oil-formulation pod; and flow control of the discharge or output (such as low, medium or high output flow). With separate pods, there may be additional heating elements, pod reservoirs and/or switching components in the hair-styling tool. These capabilities may allow for a steam only or an oil-and-water mixture to be selectively discharged. In general, in either of the types of hair-styling tools, the oil-water ratio may be dynamically adjusted (e.g., on the fly). For example, the water-and-oil combination ratio may be adjusted based at least in part on the preferences of the user and/or stylist to tackle the problem of knotty hair (such as by using high, medium, low, or off or no flow).

Figure 5:
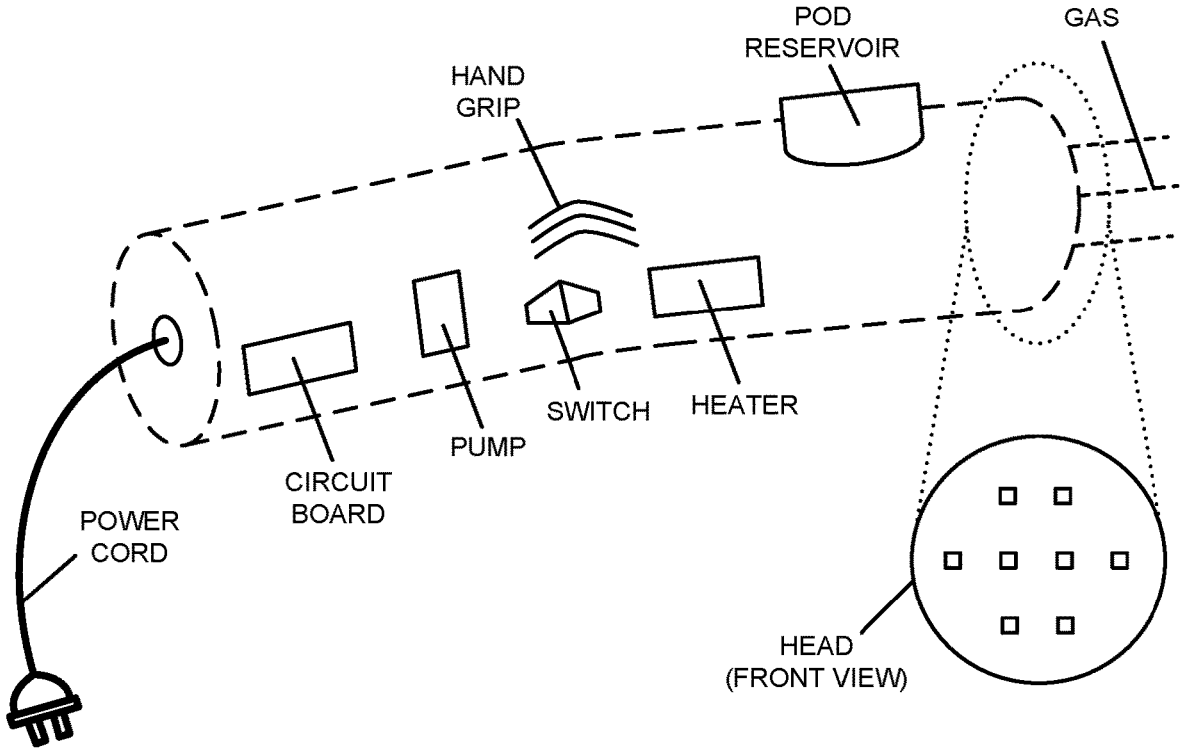
FIG. 5 is a drawing illustrating an example of a side view of a hair-styling tool in accordance with an embodiment of the present disclosure.

In some embodiment, the hair-styling tool may be cylindrical in shape and slightly bent in the middle as shown in FIG. 5, which presents a drawing illustrating an example of a side view of a hair-styling tool 500. Notably, the hair-styling tool may include: a power cord, a circuit board, a pump, a switch (e.g., to set a high, medium or low flow or a continuous flow value in a range of potential flows), a heater, a pod reservoir, a hand grip, and/or a head. In the case of a two-pod hair-styling tool, a second pod reservoir may be located directly behind the one shown in FIG. 5. Note that at least some of these components may also be included in other embodiments of the hair-styling tool.

Figure 6A:
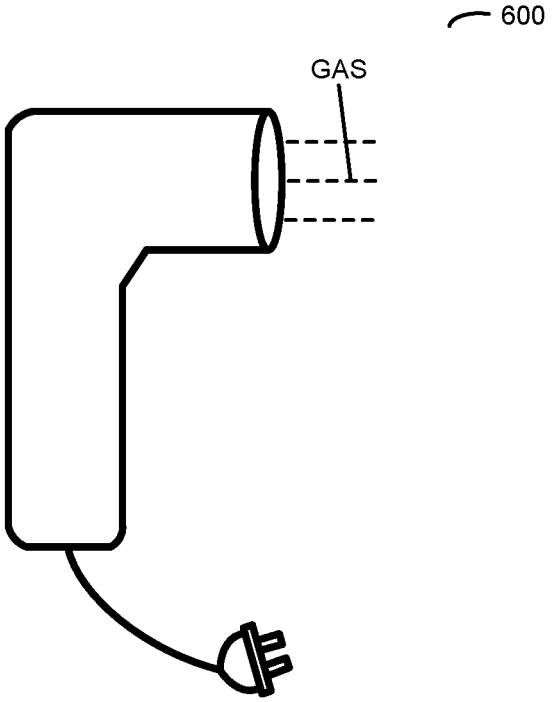
FIG. 6A is a drawing illustrating an example of a side view of a hair-styling tool in accordance with an embodiment of the present disclosure.
Figure 6B:
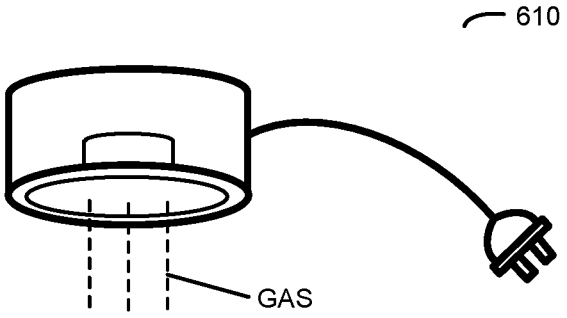
FIG. 6B is a drawing illustrating an example of a side view of a hair-styling tool in accordance with an embodiment of the present disclosure.

Other embodiments of the hair-styling tool are shown in FIGS. 6A and 6B, which present drawings illustrating example of side views of hair-styling tools 600 and 610.

In general, a given embodiment may include fewer or additional components, two or more components may be combined into a single component, a single component may be divided into two or more components, and/or positions of one or more components may be changed. Moreover, the embodiments are intended to provide illustrations of the hair-styling tool and are not intended to be limited to a particular shape or configuration.

In some embodiments, the hair-styling tool may include one or more external device components (e.g., as part of a user interface). These external device components may include: a rocker switch, an optional power cord and a hair-stylist-tool body.

For example, the hair-styling tool may include a rocker style switch (e.g., just above the bend shown in FIG. 5), which may allow a user to select the switch position with their thumb, while gripping the hair-styling tool. Moreover, there may be an indicator (such as a blue or red LED) at or near the end of the hair-styling tool to indicate the operating state. Note that the switch may allow the user to move between different flow settings (such as high, medium, or low).

Moreover, an optional or removable power cord may mate or couple to the hair-styling tool at an end of the hair-styling tool that is closest to the power switch. The power cord may be mounted on a swivel or rotatable connector, which may allow the hair-styling tool to be turned while in use, without tangling or twisting the power cord. Note that internal wiring of the power cord may include three strands of 18-gage wire, which each may have a count of 30 wires, 24 American wire gage (AWG). This may allow the power cord to be very flexible.

While it is likely that the hair-styling tool will have a power cord to power the hair-styling tool, in other embodiments the hair-styling tool may include a rechargeable battery pack. This battery pack may be located in the same place as or proximate to the power cord attachment at the base of the hair-styling tool.

Furthermore, the hair-styling-tool body may be made from molded plastic and may have a fixed color (such as tan) or may be selected from a set of available (predefined) colors. There may be two long sections to the hair-styling-tool body. Contours may be molded into the hair-styling-tool body, e.g., below the bend and on the cord end. These controls may aid or improve the ability of a user to grip the hair-styling tool.

Figure 7:
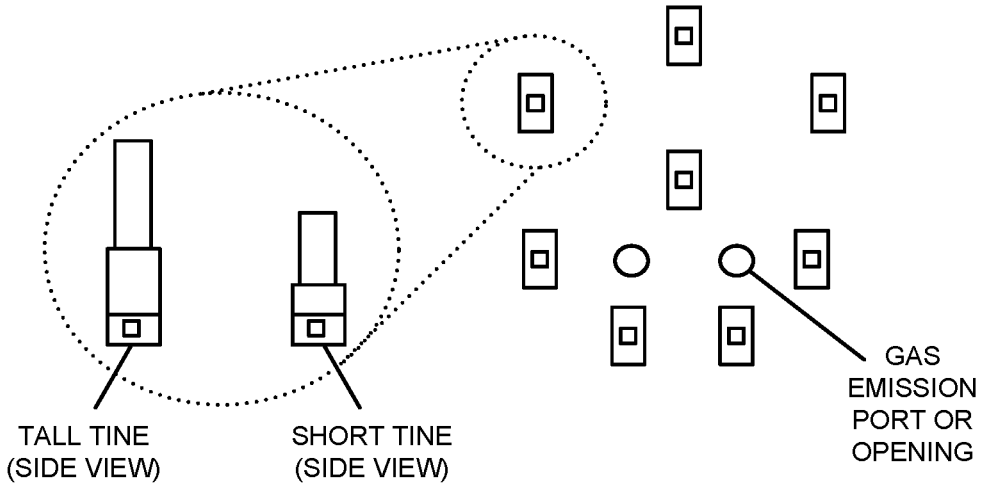
FIG. 7 is a drawing illustrating an example of a front view of a device-tine arrangement in accordance with an embodiment of the present disclosure.

As shown in FIG. 7, which presents a drawing illustrating an example of a front view of a device-tine arrangement, in some embodiments there may be an array of tines at the other end of the hair-styling tool (e.g., at or on the head). The tines may be approximately 0.1-2 cm long and may be part of the hair-styling-tool body-molded pieces. As shown in FIG. 7, the diameter of the tines may be graduated or tapered. A small ball structure may be present on the end of the tines. This end of the hair-styling tool may be used for detangling.

In some embodiments, some or all of the tines may be removed from the hair-styling tool. Additionally, specific tine types may be used depending on the length of hair and/or the severity of any knots or tangles.

Within the body portion of the hair-styling tool, at or near the end with the tines, there may be two holes that provide liquid-emission ports or openings (e.g., with a diameter of 0.1-2 mm). These liquid-emission ports may be used for emitting only steam, the oil formulation (which includes steam), or the oil formulation plus additional steam (such as separate flows). However, the liquid-emission ports may not be limited to emitting a liquid or steam. Instead, they may be used to emit or provide either one or a combination of both.

Additionally, the hair-styling tool may include two additional holes. For example, one hole may be used for low-steam discharge, two holes may be used for medium-steam discharge, and four holes may be used for high-steam discharge.

In addition to the liquid emission ports, there may be additional emissions from the sides of the tines themselves (e.g., from short tines and/or from tall tines).

Along the body of the hair-styling tool (e.g., in the portion between the bend and the tines), there may be a cavity with an inlet port where a reservoir or pod may be remateably inserted. There may be small plastic protrusions into the hair-stylist-tool body that are designed to retain or hold in place a reservoir or pod. The shape of the reservoir may be that of a teardrop, which may aid or provide quick orientation with the cavity in the body of the hair-styling tool. When installed in the cavity, the reservoir or pod may be positioned slightly higher than the surface of the hair-styling-tool body. This may present or provide an area for grabbing and removing the reservoir or pod. Note that a reservoir or pod is sometimes referred to as a 'pod chamber.'

The internal elements of the hair-styling tool may include: a circuit board (which may perform functions such as: receiving incoming power, heating and pump controls, a wireless interface, e.g., Bluetooth or Bluetooth low energy, and/or reservoir sensing); a power-cord radial connection; a power switch; a heater; a pump; tubing to convey one or more liquids or gases between some components; and/or one or more sensors (such as a temperature sensor, a flow sensor, a pressure sensor, an orientation sensor, etc.). Note that the power cord may enter the body and into a radial swivel, which may be mechanically coupled (e.g., bolted to) the hair-stylist-tool body and wires from the swivel may be electrically connected or coupled to the circuit board.

The circuit board may have wires to/from: the power swivel or the primary power input; the power switch; the heater; the pump; the one or more sensors; and/or the indicator. Moreover, the circuit board may control the operation of the hair-styling tool. For example, the control circuit board may include a processor, such as a PIC 18F family microprocessor. The PIC microcontroller may boot from an internal flash when power is applied via the power switch.

Once booted, the PIC microprocessor may turn on the indicator, which may, in general, indicate various conditions or states of the hair-styling tool. For example, the indicator may display: a solid color to indicate that the hair-styling tool is ready to operate, with steam being emitted; flash rapidly to indicate that no reservoir is present or that the reservoir is empty; or flash slowly to indicate that reservoir contents are being heated. Moreover, the PIC microprocessor may: turn off the heater; turn off the pump; and/or initialize the wireless interface and attempt to contact an application or another electronic device (such as electronic device 224 in FIG. 2).

Furthermore, the PIC microprocessor may check for the presence of the reservoir and validate the type of the reservoir. Once the reservoir type is known, the PIC microprocessor may begin the emit steam cycle. For example, operating parameters may be retrieved from flash memory. The parameters may specify to the control loop the temperature to maintain, at what temperature to turn on the pump, and the operating pressure.

The PIC microprocessor may then read the current temperature and pressure values. Additionally, the PIC microprocessor may begin operating a proportional integral derivative (PID) loop to achieve consistent emissions or output. The control loop may measure temperature and pressure, and may determine if the heater should be on or off, and if the pump should be on or off.

As discussed previously, the hair-styling tool may use a built-in electric heater to heat the liquid into a steam. As the liquid turns to steam, it will expand a flow out of the heater, out of the hair-styling tool, and onto the scalp and hair. The heater may use: an on/off (bang-bang) operation where a power source selectively energizes the heater in a full-on mode; or a proportional operation where the heat generated is related to the amount of energy applied. The energy may be provided using an electrical current with a fixed voltage, and either full current (for on/off operation) or limited in proportion to the desired amount of heat.

The amount of steam produced may depend on one or more factors that specify or determine the energy applied to the heater. For example, one or more factors may include: the type of mixture being pumped into the heater (e.g., just water, or water and oil); an external temperature and humidity; thermal resistance of the heater (e.g., how fast the temperature will rise, and how much it keeps rising even after power is reduced); the volume of steam needed; and/or the desired temperature of the emitted steam.

A PID loop may be used to control the temperature of the emitted steam. PID loops typically need an input of a setpoint (in this case, the temperature, e.g., 100 C±3 C) and a measured process variable. The PID loop may have operating parameters set so that the hair-styling tool arrives as quickly as possible to the setpoint value, and to maintain the setpoint temperature. PID loops work by producing an error amount between the measured process variable and the setpoint. The PID loop uses the error value to determine how to change the controls (including the operating parameters) in order to move the process variable to the setpoint. The process variable in this case is the emitted temperature of the steam.

The PID loop operating parameters are normally set by tuning the PID loop. Tuning is a process that is typically used to determine the correct scale factors for proportional gain, an integral scale factor, and/or a derivative scale factor. The proportional parameter may determine or specify how much gain to apply to the control parameter to reach the setpoint. The integral scale factor may add in more gain if the error persists longer than expected, and the derivative scale factor may add in a factor for rate of change to damp gain changes as the proportional gain portion is changed as the error value diminishes and approaches zero. In some embodiments, the control parameters may include the on time of the heater or the amount of current to let flow into the heater. For example, at turn on, the temperature in the heater may be the temperature of the liquid in the reservoir (which may be room temperature). At this time, the proportional gain may be at its maximum value and the error value may be at its maximum value. As the temperature rises, the error value may be reduced, and the PID loop may reduce the gain.

The parameters for operation of the PID loop may be different for water versus oil and water, as well as for different external temperature and humidity. Tuning may be performed for each of these factors, and then the operating parameters may be applied to the functions in the PID loop, e.g., based at least in part on a particular scenario. For example, as noted previously, the gain needed for water only versus the gain needed for oil and water may be different. The PIC microprocessor may electronically read the parameters from a pod and may program the corresponding operating parameters into the PID loop. For example, more energy may be needed to boil and produce steam for oil and water, than just water. This can be achieved using the same power over a longer period of time or using more power over the same time. The end result is the same: steam. The difference is the time before the hair-styling tool can be used.

The PIC microprocessor may also measure the local temperature and humidity (e.g., in the surrounding environment), and then may select operating parameters based at least in part on these factors. Additionally, because the head is detachable, if it is not properly attached to the hair-styling tool there may be inconsistencies in the pressure. The hair-styling tool may be capable of signaling pressure issues or inconsistencies.

While cycling through the PID loop, the PIC microprocessor may also look for fault conditions, such as when the temperature or pressure is too high or when a reservoir or pod is empty. When a fault condition occurs, the PIC microprocessor may turn off the heater and the pump, and may rapidly flash the indicator.

While the hair-styling tool is operating, the PIC microprocessor may collect operating and consumption information. The PIC microprocessor may measure how well it can maintain the temperature and what pressure level is needed. It may also measure how long the hair-styling tool is or has been operating, and how long a reservoir is expected to last; and/or the type(s) of reservoir(s) or pod(s) being used. When there is a wireless connection, the hair-styling tool may provide this information to an application executing on another electronic device (such as electronic device 224 in FIG. 2, which may be a cellular telephone or a computer).

For example, the heater may heat 100-500 mL of water to 100 C in 30-180 seconds. The hair-styling-tool design may have a small reservoir that is used to heat water and/or an oil-formulation pod. The heater may have, e.g., two outlet connections or tubes that are interconnected with the outlet holes at the end of the hair-styling tool. There may also be an inlet tube or connection from the pump and power to the heater that is controlled by the circuit board.

The heater may be fitted with a temperature sensor (e.g., a K type thermocouple) that reports back to the circuit board. Moreover, a pressure sensor may be mounted at the inlet tube after the pump. The pressure sensor may report measurements back to the circuit board and may electronically read a 'gage' pressure. The pressure applied to the heater (such as pounds per square inch) or the flow going into the heater may act as a proxy for what comes out on the low, medium, or high flow settings.

In some embodiments, an expansion process may push out the liquid/steam. In order for this to work, orifices or holes in the hair-styling tool may need to be different sizes, e.g., the inlet orifice pushing in water may need to be smaller than the outlet orifice(s) to ensure the generated steam does not go back into the reservoir or pod.

Note that the heater and its components can be cleaned by the user when the reservoir is removed for cleaning. For example, as described later, the heater may be quickly cleaned using a brush.

The inlet to the pump may be from a reservoir inserted externally into the top of the hair-styling tool. The outlet may be fed into the heater. The pump may be controlled by the circuit board, may operate on, e.g., 12V DC, and may consume, e.g., up to 12-24 watts of power. Note that when turned on, the pump may move liquid from the reservoir to the heater inlet.

As discussed previously, the hair-styling tool may allow for the insertion of one or more reservoirs (which are sometimes referred to as 'pods'). During operation, the contents of a reservoir may be heated and emitted. Moreover, as discussed previously, the contents of a reservoir may be water, oil, or an oil formulation that is specific to the reservoir or the hair-styling tool, such as an oil formulation corresponding to a hair type, a hair-stylist preference and/or a user preference.

The reservoir may have housing made of a soft plastic that will hold, e.g., about 100-500 mL of liquid. The reservoir may be semi-transparent or may have a semi-transparent window to permit viewing of the level of the remaining liquid. The lower front underside of the reservoir may have a small cylinder (e.g., made of plastic) that is inserted into a corresponding receptacle in the hair-styling-tool body. This cylinder may serve as a tube for transferring liquid into the hair-styling tool. The cylinder in the reservoir may have a first mechanical valve (which may be formed by the plastic). The default state of this first mechanical valve may be closed and the state may transition to open when the reservoir is inserted into the hair-styling-tool body and the tube mates with the corresponding receptacle and/or when the pump produces a reduced pressure. At the opposite end of the bottom of the reservoir there may be a smaller second mechanical cylinder valve assembly. The state of this second mechanical valve may be opened by the corresponding portion of the hair-styling tool (such as when the tube mates with the corresponding receptacle) and/or when the pump produces a reduced pressure in the tube and the reservoir. This second mechanical value may allow air into the reservoir as the liquid is pumped out. Alternatively, in some embodiments, the first mechanical valve may be a dual valve that supports liquid outtake and air intake, in which case there may not be a second mechanical valve.

The reservoir may be remateably clipped or snapped into the hair-styling-tool body, such that it will not fall out during use of the hair-styling tool while detangling hair. The top of the reservoir may extend above the top of the hair-styling-tool body to allow the user to easily grab the reservoir for removal. This reservoir or pod chamber may be easily removed for cleaning purposes. Alternatively, in some embodiments, instead of a removable reservoir, a water chamber may be included in the hair-styling tool and may be manually filled with water, e.g., via hose or tube.

The hair-styling tool may include one or more sensors, e.g., a temperature sensor and/or pressure sensor to inform the user about the amount of vapor and/or steamy oil being discharged. There are several ways to implement this type of sensing. In some embodiments, the temperature may be measured in the heating chamber, where a higher temperature results in more discharge or a higher flow rate. Moreover, there may be a sensor to measure the pressure, because if the discharge ports are blocked the pressure will rise above the normal operating pressure(s) and the hair-styling tool may need to stop the heating process in order to prevent a dangerous condition or damage to the hair-styling tool. Furthermore, there may be a sensor to measure the flow on the intake of liquid.

We now describe operation of the hair-styling tool. Prior to use of the tool, a hair stylist or a user may install a reservoir and turn on the hair-styling tool. Once the hair-styling tool is turned on, it will take a few minutes to heat the contents or the reservoir(s) to create the steam only or the oily-steam discharge. Moreover, once the hair-styling tool begins to provide a discharge, the hair stylist or user may point the hair-styling tool with the tines facing the hair and may gently glide the prongs down the hair shaft as the discharge comes from the base of the hair-styling tool and/or out of the tines. This discharge may be adjusted using the high, medium, or low rocker switch on the hair-styling tool.

As the hair stylist or user glides the tines down the hair shaft, the discharge (steam and/or oily steam) may deeply penetrate the hair, soften it and enable greater hair elasticity. Consequently, the hair may separate easily as the knots and tangles unravel with little to no hair damage or breakage.

We now describe a detangling process. When hair is compromised or tangled, the hair-strand cuticles are raised, which creates a framework for more knots and tangles because the hair can easily come together and may not easily separate. The oil provided by the hair-styling tool may make the cuticle layer go flat (or reseal it) and feel smoother. It may not hydrate the hair. Instead, the oil may just smooth it. Moreover, the steam provided by the hair-styling tool may hydrate and moisturize the inside and the outside of the hair shaft.

During this process, a hair stylist or user may determine the appropriate pod formulation to use on a customer or an individual depending on the hair issue/need (detangling, silk press etc.), porosity and/or hair type. Then, the hair stylist or user may insert the selected pod formulation into the hair-styling tool. The hair stylist or user may turn on the hair-styling tool and determine the discharge level (e.g., low, medium or high). The flow setting may depend on the type of pod used or the formulation of the pod (e.g., the oil type, the ratio of oil to water in the pod, such as just steam or an oily steam, etc.). Next, the hair stylist or the user may allow the hair-styling tool to warm up and prepare for use. Moreover, as the hair stylist or user glides the tines down the hair shaft, the discharge (steam and/or oily steam) may deeply penetrate the hair, soften it and enable greater hair elasticity. Consequently, the hair may separate easily as the knots and tangles easily unravel with no hair damage or breakage.

We now further describe operation of components in the hair-styling tool. Notably, during operation of the hair-styling tool, e.g., for the low, medium, or high discharge setting, the user may select or adjust electric controls and power conversion. For example, the user may plug the hair-styling tool into a wall outlet. Moreover, the user may have the option to select a low, medium or high setting to regulate the water or oily steam discharge. Moreover, the setting may adjust the pump speed and other factors linked to the hydraulic system. The thermo-regulation technique may also be modified because a reduced or an increased flow rate may require less or more heat per unit time.

Regarding water connectivity and the mechanics of the water chamber or reservoir, in some embodiments, the user may plug the hair-styling tool into a wall outlet. Moreover, the user may pour water into a compartment or reservoir in the hair-styling tool and/or the oil formulation may be included in a pod that is inserted into the hair-styling tool. In some embodiments, the hair-styling tool includes two pods.

However, in other embodiments, the user may have the option of hooking tubing to an external water supply to the hair-styling tool to allow for water flow into the hair-styling tool, with an additional or separate pod containing the oil formulation. In these embodiments, the hair-styling tool may include two pods.

The hair-styling tool may be used with a variety of types of oil pods and/or oil formulations. The general concept of the reservoir has already been described. In general, the hair-styling tool may be implemented using one or two pods.

In embodiments with one pod, there may be different types of pods, such as: just water (e.g., an empty pod that can be filled manually or automatically with water); or an oil formulation (which may provide an oily steam that includes oil and water).

Note that an application executing on the other electronic device may provide the hair stylist or the user with feedback or a recommendation on which type of pod (or water and/or oil formulation) to use based at least in part on a hair type and a desired outcome. This information may be manually input into the application. Alternatively, the application may automatically analyze an image of the hair (e.g., using a pretrained neural network) to determine the hair type. Moreover, the application may provide information about the hair type to the hair-styling tool, which may use this information to adjust operating parameters and/or a discharge flow of the hair-styling tool.

In some embodiments, a pod or reservoir may be authenticated in order for it to be used with the hair-styling tool. There may be several ways to verify an authenticated and approved pod is being used with the hair-styling tool. For example, one or more sensors may be included in the hair-styling tool so the hair-styling tool can automatically detect the type of oil-formulation cartridge or pod that is being used. The type of oil used and/or the weather condition (e.g., temperature and/or humidity) are some of the data that may be collected, and which may be subsequently used during operation of the hair-styling tool. For example, the one or more sensors may include: a resistive sensor, an electronic sensor, a chemical sensor, etc. Alternatively or additionally, a pod may be authenticated and approved using: mechanical keys, pins or fuses on a pod or associated packaging may communicate or indicate which pod is being used; stickers on the pod or associated packaging may provide information (e.g., optically) about which pod type is used in the hair-styling tool; Bluetooth low energy (BLE), radio-frequency identification (RFID), near-field communication (NFC), visual/optical communication with the pod or associated packaging may communicate with the hair-styling tool to provide information regarding which pod type is used (e.g., content may be read, which may allow certain temperatures or certain types of oil/water mixtures to be set); a barcode on the pod or associated packaging may be scanned by the hair-styling tool to provide information regarding what pod type is used, a temperature to be used, a mixture to be used, etc.; and/or a unique identifier for pod authentication (e.g., each pod may have a unique code that is non-fungible).

The following discussion provides embodiments of pod-verification techniques that can be used. In general, one or more of the following approaches for pod authentication may help detect a foreign substance in the pod and/or reservoir. This may discourage users from pouring unapproved substances into a pod and/or a reservoir.

For example, in some embodiments, the hair-styling tool may include embedded sensors capable of detecting and/or analyzing the composition of the substance within the pod or the substance being discharged from the pod.

Moreover, in order to ensure a verified and allowed oil-formulation pod is being used in the hair-styling tool, pin-based authentication may be used. For example, only authenticated pods may have the correct pin structure, or key-like structure, to attach to the hair-styling tool.

Furthermore, in some embodiments, active stickers or tags may be used to communicate with the hair-styling tool regarding what type of pod is being used. These embodiments may be similar to the use of RFID/NFC/BLE. For example, each pod may have an RFID tag that indicates the type of oil included in a given pod, as well as any other required attributes (thermal behavior, expiration date, authentication code, etc.). This tag may be decoded and, if valid, the data may be used by the processor in the hair-styling tool to look up the proper thermodynamic technique (and associated operating parameters). This thermodynamic technique may include: temperature information, viscosity, smoke point and/or miscibility.

Note that the thermodynamic technique may include: a thermal management task that includes the maximum ratings of the given oil (or, when oil is not used, may default to the maximum rating for water). After starting, the thermal management task may remain on. Moreover, thermal regulation may be performed by turning the heater on and off, and/or by running water through the hair-styling tool to rapidly cool the hair-styling tool. For example, the heater may be ramped up to 120 C. Then, water may run through the hair-styling tool. If the temperature does not drop significantly in 3 s, this may indicate that the water pod is empty. In this case, the hair-styling tool may shut off and the indicator may display a water-warning light. Alternatively, when there is water in the water pod, the pump may selectively pull fluid from the water and/or oil-formulation pod into the heater and then discharge the resulting vapor.

In some embodiments, one or more barcodes may be printed on each pod and scanned by the hair-styling tool prior to use. The scanning of a barcode may authenticate the pod being used. In addition, the scanning of the barcode may provide information to the user or hair stylist about temperatures to be used, tine length, etc.

We now discuss embodiments of different oil pod use cases. Notably, the following use cases may be applicable for a specific oil pod use depending on hair type and/or a service applied to the hair/scalp.

Wigs, lace front wigs, or protective styles like braids and hair extensions may be worn long enough that the scalp is unable to receive sufficient amounts of air. Also, protective styles that use synthetic or artificial materials to create hair for the braids can irritate the scalp and/or may cause itching. In these embodiments, a pod may include an anti-bacterial formulation to address the itch caused by the synthetic hair. The anti-bacterial formulation that is discharged as an oily steam may be useful for scalp care. This may help address the itch and the moist, scaly dandruff that occurs when the scalp is not receiving enough air.

Moreover, silk press is a process where hair is straightened from being textured or curly. The hair-styling tool may include or may use a pod with an oil formulation that may help maintain straight hair even in humid weather, which otherwise may cause a hair cuticle to lift and frizz. After a customer's hair is washed and dried, a hair stylist or user may use the hair-styling tool with a silk press pod. The discharge may include an oily steam or there may be the option to add more steam from a water-only pod. The stylist or user may run the tines through the customer's hair while the oily steam is discharged. The oily steam may penetrate deep into the hair. Afterwards, the hair stylist or user may use a hot-pressing hair iron or comb to seal and straighten the hair. Adding the hair-styling tool with its silk-press pod to the silk press process may result in straight hair that is able to withstand humidity and frizziness. As time goes by and the process is repeated after every wash, the hair may develop a memory of its straightness and may, therefore, lose its natural curls.

Furthermore, the hair-styling tool may be used for natural textured hair styling and care. Notably, textured hair may be molded and shaped in different styles. In order to make the process much easier, oil pods may be developed that further soften hair after it is washed and that enable more manageability to create different hair styles. Applying the oily steam using the hair-styling tool throughout the week may keep the hair style intact and may keep the hair healthy, moisturized and hydrated.

Additionally, the hair-styling tool may be used with color treated or bleached hair. Notably, changing from dark to light hair is very popular. However, it is one of the ways that hair strands are put in a compromised state. Breakage, frizz and/or dryness are just some of the side effects following bleaching or color-treating hair. For example, bleach is often used to remove natural hair color from each strand through a process of oxidation. Oxidation decolorizes the pigment in the hair shaft. It makes the hair swell, allowing the bleach to reach the inner part of the strand. It dissolves the melanin that gives the hair pigment and raises the hair's outer cuticle to allow the bleaching agent to fully penetrate. Repeated bleaching can permanently raise the cuticle scales allowing rapid and continuous loss of moisture. This can leave the hair dry, brittle, fragile, inelastic, porous and more prone to breakage and split ends.

A variety of oil pods may be created or developed to protect color-treated or bleached hair or to condition/moisturize the hair. For example, an oil pod may serve as a 'bond builder' that may protect hair from chemical damage and that prevents further damage. This pod may be inserted into the hair-styling tool, and the hair-styling tool may glide down the hair as the oily steam penetrates into the color-treated hair. This oil stream may repair the broken bonds from the coloring and may restrengthen the hair on a deep level. Alternatively, another oil pod may provide moisture to the hair. This special formulation may be used after the color treatment to put back or restore moisture in order to avoid frizzing, dryness and/or breakage.

In some embodiments, one or more of the pods may include one or more conditioners. Conditioners are typically used right after washing hair and are meant to replace the lost moisture from shampooing. They also smooth the hair cuticle, which in turn reduces tangling, increases shine and helps make hair more manageable. Depending on the hair issue or hair type, different oil-formulation pods may be created or developed and used with the hair-styling tool after the shampoo for conditioning.

For example, a hydrating/moisturizing oil formulation may be used to add moisture, shine, and smoothness to hair. This formulation may be good for thick, curly, or coarse hair. Moreover, a volumizing oil formulation/conditioner may be used when hair is fine or limp. When hair or a hair style needs a boost and lift, a volumizing oil formulation/conditioner may not weigh the hair down. Furthermore, a strengthening/fortifying oil formulation may be used for damaged, over-processed, highlighted, weak, or brittle hair. Additionally, a balancing oil formulation may include one or more balancing conditioners that provide a middle of the road option: not too moisturizing, and that do not dry hair out. In some embodiments, a smoothing/straightening hair oil formulation may include extra moisturizers and smoothing agents that help seal the cuticle and provide a smooth start for a straight/silk-pressed hairstyle. Note that, an anti-frizzing oil formulation may include one or more conditioners that are formulated for curly hair and that may be very moisturizing and that may reduce frizz.

In general, a given oil formulation may include a composition of one or more compounds (such as an oil, a conditioner, a moisturizer and/or another chemical). A given compound may constitute a percentage or concentration in the given oil formulation and may have a corresponding molecular weight. While the words 'oil formulation' are used in the present discussion, the compound(s) other than water that are used in the hair-styling tool may or may not include a type of oil (or long chain organic compound), and/or may include one or more additional compounds other than a type of oil (such as glycerin).

We now described embodiments of cleaning of the hair-styling tool. In some embodiments, the hair-styling tool may be manually cleaned and/or there may be a self-cleaning technique. During manual cleaning, the heater and its components may be cleaned by the user when a reservoir or pod is replaced or is removed for cleaning. The heater may be cleaned using a brush and a cleaning solution (e.g., a water-vinegar mixture or another decalcification solution).

Alternatively, in some embodiments, the hair-styling tool may have a self cleaning capability. Self-cleaning may be initiated by a user based at least in part on a predetermined time interval since a previous cleaning and/or based at least in part on the hair-styling tool sensing a need for cleaning (e.g., based at least in part on debris buildup, clogging, etc.). The self-cleaning process may be accomplished using a special pod containing the cleaning elements (such as a cleaning solution). For example, the cleaning solution may be a water-vinegar mixture or another decalcification solution. In some embodiments, such a self-cleaning pod may be inserted and run through the hair-styling tool to clean various components.

We now describe software and hair-styling-tool integration. The disclosed hair-styling tool and electronic device (such as electronic device 224 in FIG. 2) may interact via an application that executes on the electronic device. Notably, the hair-styling tool and the electronic device may communicate using over-the-air (OTA) technology. In general, the software may include that application that is installed and executed on the electronic device. This application may communicate with the hair-styling tool (e.g., using Bluetooth classic or BLE). For example, the application on the electronic device may provide information about hair type, hair issues and/or the oil to use to the hair-styling tool. In some embodiments, a hair stylist or user may manually enter, via a user interface in the electronic device, information regarding hair type, hair issues and/or the oil to use, which may be provided to the hair-styling tool.

Moreover, the hair-styling tool may include software such as: firmware or embedded software that is executed by one or more embedded microcontrollers or processor that connect, e.g., via BLE, to the electronic device. The hair-styling tool may communicate any issues to the application, such as: clogging, over temperature, device malfunction, a counterfeit pod or fluid/oil, and/or evidence of tampering (such opening of the hair-styling tool).

In addition, there may be backend infrastructure (such as a cloud-based computer or computer system that communicates with the electronic device via a network, such as the Internet via Ethernet or a cellular-telephone network via a cellular-telephone communication protocol) that harvests or collects data and that may determine human-usage patterns or other behavioral patterns (such as how the hair-styling tool is used), faults or errors and/or that may push updates to the hair-styling tool. Furthermore, the hair-styling tool, the application and/or the backend infrastructure may include one or more pretrained models (such as a neural network, e.g., a convolutional neural network, or a predictive model that is trained using a supervised-learning technique and/or an unsupervised-learning technique) that may allow patterns to be determined in the data/customer behavior data and that may allow conclusions or remedial actions to be determined or selected. For example, the supervised-learning technique may include: support vector machines, classification and regression trees, logistic regression, LASSO, logistic LASSO regression, linear regression, a Bayesian technique, and/or another (linear or nonlinear) supervised-learning technique. Moreover, the unsupervised-learning technique may include a clustering technique.

In general, the hair-styling tool, the application and/or the back-end infrastructure may be capable of: collecting and sharing data with the cloud; communicating issues and perform device troubleshooting; providing device updates, servicing requests and repairs; integrating and tracking unauthorized materials/oil pods used in the hair-styling tool; tracking demographics, geographic location and/or local weather or environmental conditions; providing feedback regarding use of the hair-styling tool (e.g., detangling versus frizz control); and/or tracking user usage. For example, user usage may include: a length of time of use; a frequency of use; a type of fluid or oil used; a type of pod used; a hair type, any hair issues; date, time and/or location information (if enabled by a user and/or tracked by the hair-styling tool); and/or additional information. Note that each functional unit or module in the hair-styling tool may be monitored using hardware and/or software to ensure optimal temperature control and tampering detection (e.g., pod, hair-styling-tool internals, etc.).

In some embodiments, the hair-styling tool may obtain information regarding an oil-water ratio or mixture to use and its effectiveness. This information may allow the hair-styling tool to make dynamic or on-the-fly changes or recommendations on use of the hair-styling tool (such as that a particular oil formulation, flow rate, temperature, pressure, etc. should be used with a particular hair type). For example, the application on the electronic device may provide feedback in real time on a ratio of oil to water to use based at least in part on the hair type.

Moreover, in some embodiments, some or all of the preceding information that is obtained may be sent to the back-end infrastructure, e.g., in the cloud. In other embodiments, the software/application may communicate issues or problems the hair-styling tool is experiencing and/or may provide updates and repair information. Notably, the hair-styling tool may communicate information about an issue to the application, which may send the information to the cloud. Similarly, the cloud may provide updates or fixes to the firmware in the hair-styling tool.

By using and/or combining the preceding components and techniques, a knowledge-based data structure of different hair types can be created by consumers and/or hair stylists, e.g., by using image sensors on their cellular telephones to photograph hair (to understand proteins, raw elements, bonds, etc.), which may then be analyzed using machine learning (such as a pretrained neural network or supervised-learning model). The machine learning may allow patterns in the data to be determined and conclusions to be computed or determined, and then disseminated to instances of the hair-styling tool. These conclusions may not only provide more knowledge, but may spawn new product offerings and recommendations for improved use of the hair-styling tool.

In some embodiments, the hair-styling tool may track whether different oils are more suitable for different types of hair problems/treatment (such as detangling versus defrizzing). For example, it may be assumed a priori that certain types of oil may be used for different hair types or issues, such as argan oil for frizzy hair and olive oil for dry and damaged hair. Using the hair-styling tool, a user may be able to identify these trends using data collected that corresponds to the hair type and the oil formulation used. This data may be manually input by the user or hair stylist (e.g., into the application). Alternatively, in some embodiments, at least some of the data may be automatically collected or determined by the hair-styling tool and/or the application.

In addition to updates, the hair-styling tool may communicate, via the application on the electronic device, any issues that have occurred, such as: clogging (which may occur when steam is unable to be discharged from the holes, e.g., because of oil, dirt or grease blocking the holes), over temperature, hair-styling-tool malfunction, counterfeit fluid/oil, and/or tampering (e.g., opening the hair-styling tool). For example, the hair-styling tool may sense over pressure in the heating chamber as a way to identify clogging.

We now described embodiments of different oil formulations. Oils are often used for various cosmetic purposes, such as in shampoos, serums, and other hair products. Scalp issues, hair conditions, hair type, hair porosity and moisture retention all can influence the type of oil/oils used. In general, there are two classifications of oils used on hair: essential oils, and carrier oils.

An essential oil is distilled from a plant and has its signature scent or odor. Essential oils are highly concentrated. For example, it may take 220 pounds of lavender flowers to make a single pound of lavender oil. However, essential oils typically are not be applied directly to the scalp unless mixed with a carrier oil because they will cause a rash, redness, burns, etc.

Carrier oils (such as coconut oil, jojoba oil, almond oil, or olive oil) also come from plants, but they have a more neutral smell. They are also not necessarily distilled down like essential oils are. Carrier oils are often used to dilute essential oils. They can also be applied to the scalp and hair without being diluted.

Moreover, different oils may be used depending on particular hair or scalp issues. One reason that scalp conditions/issues have become more prevalent is because more people are wearing wigs, weaves and braids. Furthermore, a deficient diet and/or stress can also cause scalp issues. Scalp issues/conditions can result in hair loss, slow or no hair growth, a lack of sebum production and/or a dry scalp. These issues can be address by using natural remedies, such as essential oils. These essential oils, once mixed with carrier oils, help to mitigate these conditions.

For example, for a dry scalp, the essential oils used may include tea tree, rosemary, peppermint, and/or lavender. These essential oils will soothe the itchy scalp, unclog and strengthen hair follicles, naturalize the scalp oils, condition the hair and promote hair growth.

Alternatively, for hair loss, the essential oils used may include rosemary, cedarwood, and/or clary sage. These essential oils penetrate the hair follicles increasing circulation to the scalp, promoting hair growth, etc. These essential oils also help to balance the natural production of the scalp's sebum, which moisturizes the new growth. Note that black castor oil is a good carrier oil for hair growth, because it thickens hair follicles and promotes hair growth.

Furthermore, for dandruff, the essential oils used may include cedarwood, rosemary, and tea tree oil. The carrier oil jojoba may be used for dry scalp and dandruff control. The seeds of the jojoba plant are high in liquid wax and essential fatty acids found to possess moisturizing properties. When used in shampoos and conditioners, jojoba oil may help soften and restore luster to dull hair. In addition, it may help treat dry scalp and aid in dandruff control.

Another essential oil that regulates dryness, excess oil and the production of sebum is geranium essential oil. Geranium essential oil may balance secretions around the hair follicles.

A variety of other carrier oils may be used to address hair issues.

For example, coconut oil is one of the most popular natural products for hair care. It includes lauric acid (a type of saturated fat). According to scientists, lauric acid found in coconut oil has a rare ability to penetrate inside the hair shaft and, in turn, to repair damaged hair. Moreover, treatment with coconut oil may help to reduce the loss of protein from hair. (The hair's main component, protein, may be damaged by chemical processes such as dyeing and highlighting.) Coconut oil is widely favored as a moisture-boosting hair treatment. The chemical constituents of coconut carrier oils include: lauric acid, capric acid and caprylic acid, linoleic acid (polyunsaturated fats), oleic acid (monounsaturated fats), polyphenols (virgin coconut oil only), and medium-chain triglycerides.

Like coconut oil, olive oil penetrates into hair fibers in a way that few other oils can. The abundance of monounsaturated fats found in olive oil may play a role in its deeply penetrating, hair-strengthening properties. Because it is moisturizing, olive oil may help save hair from weather-related dryness during the winter months. The chemical constituents of olive carrier oil include: oleic acid, linoleic acid, palmitic acid, stearic acid, linolenic acid, polyphenols, vitamin E, carotenoids, and squalene.

Argan oil comes from the kernels of a tree native to Morocco. This oil is often used for many hair types, including frizzy, coarse, and brittle hair. Praised for its conditioning effects, argan oil is packed with essential fatty acids that may leave hair more manageable. The chemical constituents of argan carrier oil include: oleic, linoleic, palmitic, stearic, and linolenic acids.

Like nuts and seeds, avocados are a top source of vitamin E (an antioxidant compound found to fight hair loss when taken in supplement form). While it's not known whether applying vitamin E-rich oil to the scalp promotes hair growth, avocado oil is often used to prevent hair breakage and repair damaged hair. The chemical constituents of avocado carrier oil include: palmitic acid, palmitoleic acid, stearic acid, oleic acid, linoleic acid, alpha-linolenic acid, arachidic acid, and gadoleic acid.

One of the lighter choices when it comes to nut oils, sweet almond oil is thought to treat dullness and dryness without weighing hair down. Many people also value sweet almond oil as a natural solution for dry scalp and dandruff. The chemical constituents of sweet almond carrier oil include: oleic acids (omega 9), linoleic acids (omega 6), stearic acid, and palmitic acid.

Grapeseed oil is extracted from the seeds of grapes and provides numerous benefits for the hair. Notably, it contains vitamin E, flavonoids, linoleic acid, and OPCs (oligomeric proanthocyanidins), all of which are necessary for healthy hair growth and vitality. Grapeseed oil seals in moisture and hydrates the hair, and because of its lightweight texture (which is great for fine hair), it does not leave the hair feeling greasy. Moreover, grapeseed oil is a good sealant when used after applying a water-based moisturizer. This is because grapeseed oil contains a lower amount of monosaturated lipids (fats that can penetrate the hair strand) and higher amounts of linoleic acid (fats that sit on top of the hair strand). Grapeseed oil can address frizzy hair and it smooths split ends. When massaged into the scalp, grapeseed oil may address dandruff. With its high levels of antioxidants, vitamin E, and omegas, it can help strengthen weak or brittle hair and restore shine. Grapeseed carrier oil includes: linoleic acid, oleic acid, palmitic acid, stearic acid, palmitoleic acid, vitamin E, and beta-carotene.

Soybean oil is often used for moisture retention. This carrier oil is full of good fatty acids, manganese, and vitamins. Also, the lipids in soybean oil help hair treatments to absorb better into hair. It is a non-greasy carrier oil that may improve moisture retention and shine. There is a high vitamin E content in soybean oil, so it will fight off free radicals while also being a helpful antioxidant for the scalp. This non-greasy carrier oil is great for sealing hair and ends. Soybean oil can be used as a base oil for essential oils. Furthermore, soybean oil is great as a hot-oil treatment, pre-poo (or pre-shampooing), and/or addition to conditioners. Soybean oil is composed of five fatty acids: palmitic acid (16:0), stearic acid (18:0), oleic acid (18:1), linoleic acid (18:2), and linolenic acid (18:3).

Furthermore, baobab carrier oil is a favorite choice among those with curly hair. Sourced from the fruit of the baobab tree (a plant native to Africa), this oil is said to enhance hair's elasticity, increase suppleness, and adds a non-greasy shine. Baobab oil contains fatty acids (omega 3, 6, and 9), vitamin E, calcium, alfa and beta-carotenes, uronic acid, tannins and phytosterols. Note that the fatty acid breakdown includes oleic acid (omega 9): 23-44%

Pomegranate carrier oil is a deeply penetrating oil that may help to add hydration to the hair follicle and may not leave a greasy residue. This carrier oil helps to balance the oil production in the scalp by moderating pH level. It may work effectively on all hair types to hydrate dull, dry strands and to protect it against harsh environmental stressors such as pollution. By stimulating circulation to the scalp and eliminating dirt and buildup therein, pomegranate oil may prevent damage to the hair follicles and increase the growth of stronger, healthier hair. Its antibacterial properties may protect the scalp against bacteria that contribute to conditions such as scalp psoriasis and scalp eczema. It relieves redness, itchiness, and inflammation associated with these conditions. The main ingredients in pomegranate carrier oils include: punicic acid, oleic acid, linoleic acid, palmitic acid, stearic acid, phytosterols, and tocopherol (vitamin E).

Marula oil is a carrier oil extracted both from the kernels and the nuts of the marula fruit tree, which is native to parts of southern Africa. Though it was once a wild and rare growth, these trees are now cultivated to suit beauty needs, and the oil has a soft, fruity, floral scent. It absorbs easily, reduces frizz, can tame hair without looking greasy and is antimicrobial. Marula oil is typically great for all hair types, but if hair is kinky or coarse, it is best to infuse it into a deep conditioner for better penetration. Marula oil works well with other essential oils, as well as products like shampoos and conditioners to boost hydration. The chemical constituents of Marula Carrier Oil include: oleic acid, palmitic acid, stearic acid, linoleic acid, and arachidonic acid.

Hemp oil (essential oil) and hemp seed oil (carrier oil) may sound the same, but they provide different benefits for the hair. They both come from the cannabis plant, but hemp oil is derived from the leaves and the stalk. Meanwhile, hemp seed oil is derived from the seeds, and is cold-pressed, similar to carrier oils like jojoba and sunflower seed. The biggest difference between the two is that hemp oil is full of cannabinoids, like THC, CBN, and CBD, while hemp seed oil doesn't have any of these. Hemp seed oil does have antioxidants, as well as omega-3 and omega-6 fatty acids, which make it useful in skin care. It is known for its moisturizing and non-comedogenic properties, and because the scalp is skin, that means potentially good things for hair too. The chemical constituents of hemp seed carrier oil include: linoleic acid, α-linolenic acid, oleic acid, palmitic acid, stearic acid, and γ-linolenic acid. Hemp oil contains anti-irritant, anti-inflammatory topical properties. It is rich in amino acids, vitamins and antioxidants, which provide nourishing and soothing benefits for the scalp. Hemp oil provides nourishment and hydration, because it has one of the highest concentrations of polyunsaturated fatty acids of all naturally occurring oils. It is non-greasy and provides an optimal balance for moisture retention.

Note that oils may be blended to address different issues, such as hair thinning and dandruff. For example, for damaged hair, olive oil and almond oil may be used. Notably, using heat styling tools or recently bleaching hair strands can cause ends to look fuzzy, dry and worse for wear. Olive oil may be used for this kind of hair, because it will coat it from the outside-in, making the strands feel smooth and look polished. Being rich in nutrients and with an oily, viscous consistency, olive oil is often an ideal natural balm for hair. In addition to having a detangling effect, it nourishes hair deeply, leaving it soft to touch. Alternatively or additionally, argan oil, which is extremely rich in vitamin E, may help keep the follicles free from splitting and fraying.

Moreover, for dandruff, coconut oil and jojoba oil may be used. Coconut oil is considered a jack-of-all-trades when it comes to its beauty uses, but it can be too thick and viscous for those with fine or thin hair. Instead, it works well as a scalp soother for those with inflamed, dandruff-prone hair. Coconut oil is a rich natural source for lauric acid, a fatty acid that plays multiple roles as an antimicrobial agent, a moisturizer and a hormone regulator, all of which help to fight seborrheic dermatitis and dandruff. In most cases, dandruff is not caused due to dry hair. Instead, oily hair provides an ideal environment for the malassezia fungus to grow. The benefit of jojoba oil for this case is that its structure closely resembles the building blocks of skin (specifically human sebum). Because it so closely resembles the skin's natural oil, its application signals that a healthy oil balance has been reached and the skin can now stop producing more oil.

Furthermore, for frizz, apricot kernel oil and almond oil may be used. Apricot kernel oil (or gutti ka tel) is a light oil that has occlusive properties, making it a great addition to combat moisture loss. It is rich in both oleic and linoleic acid. The former makes hair softer, while the latter aids in hydrating retention. For those with high porosity hair, this is often ideal. Apricot oil seals moisture into the hair shaft by shaping the scales of the cuticle and sealing them together. This helps protect the hair from harsh elements and damage, and smooth cuticles encourage shinier strands. Almond oil contains nourishing properties and high levels of vitamin E, magnesium and omega-rich fatty acids, which gives it an immediate shine when applied. Note that for best results, the light oils may be premixed to distribute the oil evenly, and then applied down the lengths of the hair strands to smooth frizz and flyaways.

Additionally, for hair growth, castor oil and grapeseed oil may be used. Castor oil is claimed to be a growth agent for eyebrows and eyelashes. While it is not proven that castor oil can increase hair growth, it can help improve blood circulation to the scalp, making other growth-inducing products work better. Castor oil includes ricinoleic acid, a fatty acid that stimulates a receptor to cause blood vessel dilation. This can increase the flow of nutrient-rich blood to the follicle or the root of the hair. Grapeseed oil is a possible addition. Grapeseed oil includes a high level of antioxidants that may act as a dihydrotesterone (DHT) blocker (the hormone related to male and female pattern baldness). By applying the two hair oils as a hair mask (focusing on massaging it onto the scalp and down the ends), the moisturizing qualities of these oils can prevent breakage and dryness too.

Table 1 summarizes the properties of several carrier oils.

TABLE 1

| Carrier Oil | Ingredients |
|---|---|
| Jojoba | The chemical constituents of jojoba carrier oil include: gadoleic acid (eicosenoic acid), erucic acid, oleic acid, palmitic acid, palmitoleic acid, stearic acid, behenic acid, vitamin E, and vitamin B complex. |
| Apricot Kernel Oil | The chemical constituents of apricot kernel carrier oil include: oleic acids, linoleic acids, alpha-linolenic acid, palmitic acid, stearic acid, vitamin A, and vitamin E. |
| Argan | The chemical constituents of argan carrier oil include: oleic, linoleic, palmitic, stearic, and linolenic acids. |
| Avocado | The chemical constituents of avocado carrier oil include: palmitic acid, palmitoleic acid, stearic acid, oleic acid, linoleic acid, alpha-linolenic acid, arachidic acid, and gadoleic acid. |
| Castor | The chemical constituents of castor carrier oil include: ricinoleic acid, oleic acid, linoleic acid (omega-6 fatty acid), α-linolenic acid (alpha-linolenic acid-omega-3 fatty acid), stearic acid, and palmitic acid. |
| Grapeseed | The chemical constituents of grapeseed carrier oil include: linoleic acid, oleic acid, palmitic acid, stearic acid, palmitoleic acid, vitamin E, and beta-carotene. |
| Olive | The chemical constituents of olive carrier oil include: oleic acid, linoleic acid, palmitic acid, stearic acid, linolenic acid, polyphenols, vitamin E, carotenoids, and squalene. |
| Sweet Almond | The chemical constituents of sweet almond carrier oil include: oleic acids (omega 9), linoleic acids (omega 6), stearic acid, and palmitic acid. |
| Soybean | Soybean oil is composed of five fatty acids: palmitic acid, stearic acid, oleic acid, linoleic acid, and linolenic acid. |
| Hemp Seed Oil | Linoleic acid, α-linolenic acid, oleic acid, palmitic acid, stearic acid, and γ-linolenic acid. |
| Pomegranate | The main ingredients in pomegranate carrier oils include: punicic acid, oleic acid, linoleic acid, palmitic acid, stearic acid, phytosterols, and tocopherol (vitamin E). |

TABLE 1-continued

| Carrier Oil | Ingredients |
|---|---|
| Marula | The chemical constituents of marula carrier oil include: oleic acid, palmitic acid, stearic acid, linoleic acid, and arachidonic acid. |
| Baobab | Baobab oil includes: fatty acids (omega 3, 6, and 9), vitamin E, calcium, alfa and beta-carotenes, uronic acid, tannins and phytosterols. Fatty acid breakdown: oleic acid (omega 9): 23-44% |

We now describe preferred oils for different hair types. Referring back to FIG. 1, because type 1 hair is straight, some oils can provide weight that makes it look greasy and limp. On the other hand, this hair also can experience frizz and flyaways. Consequently, lightweight oils such as grapeseed oil may be used for type 1 hair.

For type 2 hair, oils that are rich in fatty acids and vitamin E can help turn dry, coarse and unruly type 2 hair into softer, shinier and more manageable hair. These oils may also reduce dryness of the scalp, dandruff, frizz and fly-aways. Jojoba and grapeseed oils may be used for type 2 hair strands.

For type 3A hair, jojoba oil, olive oil, grapeseed oil, avocado oil, coconut oil and/or soybean oil may be used. Alternatively, for type 3B hair, jojoba oil, marula oil, olive oil, coconut oil and/or sweet almond oil may be used. Moreover, for type 3C hair, jojoba oil, almond oil, coconut oil, olive oil and/or argan oil may be used.

Furthermore, for type 4A hair, jojoba oil, castor oil, olive oil and/or argan oil may be used. Alternatively, for type 4B hair, castor oil, coconut oil, olive oil and/or avocado oil may be used. Additionally, for type 4C hair, castor oil, coconut oil, olive oil, marula oil and/or avocado oil may be used.

Regarding the impact of hair porosity on the selected oil(s), hair porosity may indicate how well hair can absorb moisture. There are oils that can help retain moisture in hair. When using the liquid, oil cream (LOC) method, oils that seal in water/moisture should be used. Lighter oils may be recommended for low porosity hair, while heavy oils may be better for high porosity hair to combat moisture loss.

For hair with high porosity, 'heavy oils' may need to be applied. The hair shaft may need to seal in the moisture because of the gaps in the cuticle, thereby increasing moisture retention. Suggested oils include: castor oil, coconut oil, hemp seed oil, jojoba, and/or olive oil. These heavy oils may penetrate the hair shaft and seal the hair.

Alternatively for hair with low porosity, 'light oils' may be used, because the hair shafts are tightly sealed. These oils may seal in the moisture by absorbing into the hair shaft. Examples of these types of lighter oils include: grapeseed, argan, jojoba, apricot, pomegranate, and/or sweet almond oil. The fatty acids in these oils may make them a good choice for low porosity hair, because they will not cause the hair to be weighed down.

While the preceding discussion of the hair-styling techniques used scalp hair as an illustration, in other embodiments the hair-styling techniques may be used with hair at other body locations, such as facial hair (e.g., a beard or mustache) or pubic hair.

Some of the benefits of beard steaming may include: opening the pores of skin to help eliminate blackheads; increasing moisture or hydration (which may reduce or eliminate 'beardruff' or beard dandruff, may increase the shine of a beard, and/or may be useful for low-porosity hair); softening and smoothing the hair shaft (such as for coarser beard texture), which may make combining, brushing and styling easier; increasing blood flow and circulation, which may promote beard growth; reducing dryness, such as during the winter months; and reducing tangling and breakage. Consequently, the hair-styling tool may be used to groom beards. Note that the use of an oily steam' formulation, which includes fatty acids, may penetrate deep into the beard hair and stimulate growth. While steam alone may be beneficial, the oily steam from the hair-styling tool provides may provide added benefits, such as simulating growth, increased, longer-lasting softening, detangling, as well as improving the efficiency of beard maintenance.

Figure 8:
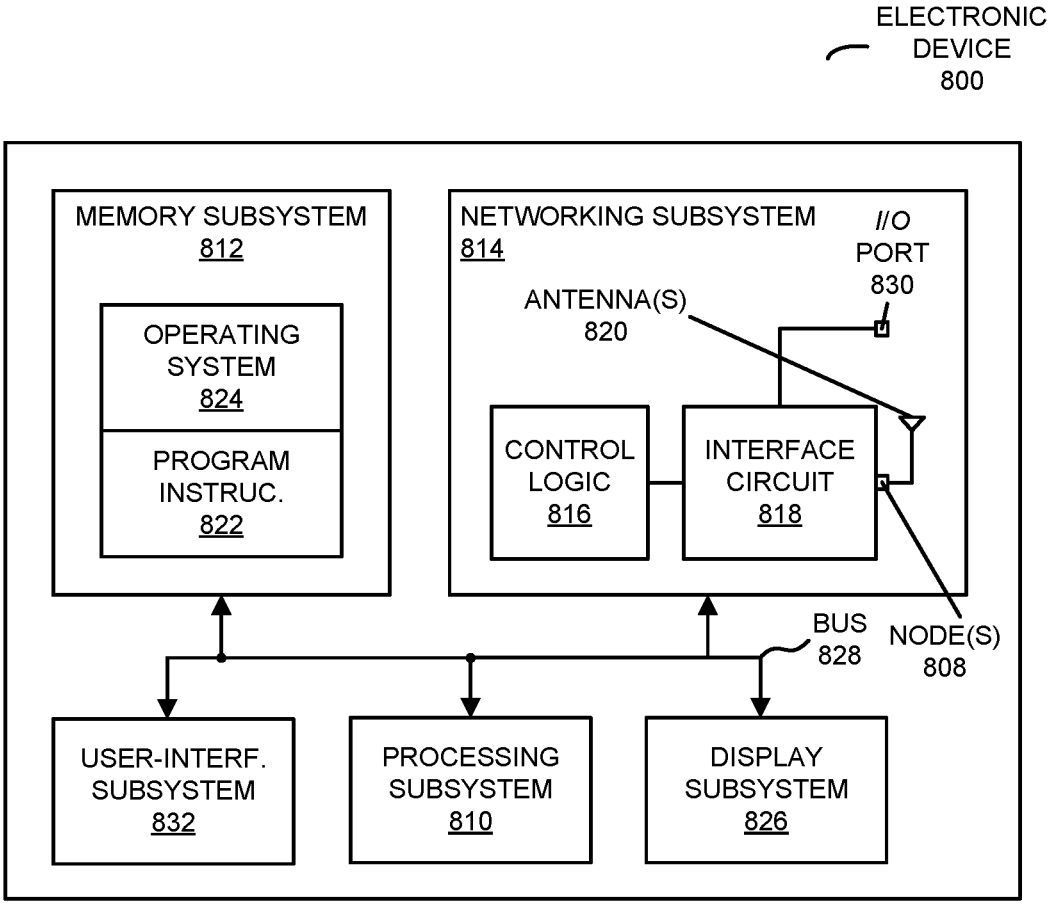
FIG. 8 is a block diagram illustrating an example of an electronic device in accordance with an embodiment of the present disclosure.

We now describe embodiments of an electronic device, which may perform at least some of the operations in the hair-styling techniques. Note that the electronic device may include hair-styling tool 200 (FIG. 2) or electronic device 224 (FIG. 2). FIG. 8 presents a block diagram illustrating an example of an electronic device 800 in accordance with some embodiments. This electronic device includes processing subsystem 810, memory subsystem 812, and networking subsystem 814. Processing subsystem 810 includes one or more devices configured to perform computational operations. For example, processing subsystem 810 can include one or more microprocessors, ASICs, microcontrollers, programmable-logic devices, one or more graphics process units (GPUs) and/or one or more digital signal processors (DSPs).

Memory subsystem 812 includes one or more devices for storing data and/or instructions for processing subsystem 810 and networking subsystem 814. For example, memory subsystem 812 can include dynamic random access memory (DRAM), static random access memory (SRAM), and/or other types of memory. In some embodiments, instructions for processing subsystem 810 in memory subsystem 812 include: one or more program modules or sets of instructions (such as program instructions 822 or operating system 824), which may be executed by processing subsystem 810. Note that the one or more computer programs may constitute a computer-program mechanism. Moreover, instructions in the various modules in memory subsystem 812 may be implemented in: a high-level procedural language, an object-oriented programming language, and/or in an assembly or machine language. Furthermore, the programming language may be compiled or interpreted, e.g., configurable or configured (which may be used interchangeably in this discussion), to be executed by processing subsystem 810.

In addition, memory subsystem 812 can include mechanisms for controlling access to the memory. In some embodiments, memory subsystem 812 includes a memory hierarchy that comprises one or more caches coupled to a memory in electronic device 800. In some of these embodiments, one or more of the caches is located in processing subsystem 810.

In some embodiments, memory subsystem 812 is coupled to one or more high-capacity mass-storage devices (not shown). For example, memory subsystem 812 can be coupled to a magnetic or optical drive, a solid-state drive, or another type of mass-storage device. In these embodiments, memory subsystem 812 can be used by electronic device 800 as fast-access storage for often-used data, while the mass-storage device is used to store less frequently used data.

Networking subsystem 814 includes one or more devices configured to couple to and communicate on a wired and/or wireless network (i.e., to perform network operations), including: control logic 816, an interface circuit 818 and one or more antennas 820 (or antenna elements) and/or input/output (I/O) port 830. (While FIG. 8 includes one or more antennas 820, in some embodiments electronic device 800 includes one or more nodes, such as nodes 808, e.g., a network node that can be coupled or connected to a network or link, or an antenna node or a pad that can be coupled to the one or more antennas 820. Thus, electronic device 800 may or may not include the one or more antennas 820.) For example, networking subsystem 814 can include a Bluetooth™ networking system (such as Bluetooth classic or Bluetooth low energy), a cellular networking system (e.g., a 3G/4G/5G network such as UMTS, LTE, etc.), a universal serial bus (USB) networking system, a networking system based on the standards described in IEEE 802.11 (e.g., a Wi-Fi® networking system), an Ethernet networking system, a cable modem networking system, and/or another networking system.

Networking subsystem 814 includes processors, controllers, radios/antennas, sockets/plugs, and/or other devices used for coupling to, communicating on, and handling data and events for each supported networking system. Note that mechanisms used for coupling to, communicating on, and handling data and events on the network for each network system are sometimes collectively referred to as a 'network interface' for the network system. Moreover, in some embodiments a 'network' or a 'connection' between the electronic devices does not yet exist. Therefore, electronic device 800 may use the mechanisms in networking subsystem 814 for performing simple wireless communication between the electronic devices, e.g., transmitting advertising or beacon frames and/or scanning for advertising frames transmitted by other electronic devices.

Within electronic device 800, processing subsystem 810, memory subsystem 812, and networking subsystem 814 are coupled together using bus 828. Bus 828 may include an electrical, optical, and/or electro-optical connection that the subsystems can use to communicate commands and data among one another. Although only one bus 828 is shown for clarity, different embodiments can include a different number or configuration of electrical, optical, and/or electro-optical connections among the subsystems.

In some embodiments, electronic device 800 includes a display subsystem 826 for displaying information on a display, which may include a display driver and the display, such as a liquid-crystal display, a multi-touch touchscreen, etc.

Electronic device 800 can be (or can be included in) any electronic device with at least one network interface. For example, electronic device 800 can be (or can be included in): a hair-styling tool, a computer, a computer system, a desktop computer, a laptop computer, a subnotebook/netbook, a tablet computer, a smartphone, a cellular telephone, a smartwatch, a consumer-electronic device, a portable computing device, and/or another electronic device.

Although specific components are used to describe electronic device 800, in alternative embodiments, different components and/or subsystems may be present in electronic device 800. For example, electronic device 800 may include one or more additional processing subsystems, memory subsystems, networking subsystems, and/or display subsystems. Additionally, one or more of the subsystems may not be present in electronic device 800. Moreover, in some embodiments, electronic device 800 may include one or more additional subsystems that are not shown in FIG. 8, such as a user-interface subsystem 832. Also, although separate subsystems are shown in FIG. 8, in some embodiments some or all of a given subsystem or component can be integrated into one or more of the other subsystems or component(s) in electronic device 800. For example, in some embodiments program instructions 822 are included in operating system 824 and/or control logic 816 is included in interface circuit 818.

Moreover, the circuits and components in electronic device 800 may be implemented using any combination of analog and/or digital circuitry, including: bipolar, PMOS and/or NMOS gates or transistors. Furthermore, signals in these embodiments may include digital signals that have approximately discrete values and/or analog signals that have continuous values. Additionally, components and circuits may be single-ended or differential, and power supplies may be unipolar or bipolar.

An integrated circuit (which is sometimes referred to as a 'communication circuit') may implement some or all of the functionality of networking subsystem 814 (or, more generally, of electronic device 800). The integrated circuit may include hardware and/or software mechanisms that are used for transmitting wireless signals from electronic device 800 and receiving signals at electronic device 800 from other electronic devices. Aside from the mechanisms herein described, radios are generally known in the art and hence are not described in detail. In general, networking subsystem 814 and/or the integrated circuit can include any number of radios. Note that the radios in multiple-radio embodiments function in a similar way to the described single-radio embodiments.

In some embodiments, networking subsystem 814 and/or the integrated circuit include a configuration mechanism (such as one or more hardware and/or software mechanisms) that configures the radio(s) to transmit and/or receive on a given communication channel (e.g., a given carrier frequency). For example, in some embodiments, the configuration mechanism can be used to switch the radio from monitoring and/or transmitting on a given communication channel to monitoring and/or transmitting on a different communication channel. (Note that 'monitoring' as used herein comprises receiving signals from other electronic devices and possibly performing one or more processing operations on the received signals)

In some embodiments, an output of a process for designing the integrated circuit, or a portion of the integrated circuit, which includes one or more of the circuits described herein may be a computer-readable medium such as, for example, a magnetic tape or an optical or magnetic disk. The computer-readable medium may be encoded with data structures or other information describing circuitry that may be physically instantiated as the integrated circuit or the portion of the integrated circuit. Although various formats may be used for such encoding, these data structures are commonly written in: Caltech Intermediate Format (CIF), Calma GDS II Stream Format (GDSII), Electronic Design Interchange Format (EDIF), OpenAccess (OA), or Open Artwork System Interchange Standard (OASIS). Those of skill in the art of integrated circuit design can develop such data structures from schematics of the type detailed above and the corresponding descriptions and encode the data structures on the computer-readable medium. Those of skill in the art of integrated circuit fabrication can use such encoded data to fabricate integrated circuits that include one or more of the circuits described herein.

While the preceding discussion used particular communication protocols as an illustrative example, in other embodiments a wide variety of communication protocols and, more generally, wired and/or wireless communication techniques may be used. Thus, the hair-styling techniques may be used in conjunction with a variety of network interfaces. Furthermore, while some of the operations in the preceding embodiments were implemented in hardware or software, in general the operations in the preceding embodiments can be implemented in a wide variety of configurations and architectures. Therefore, some or all of the operations in the preceding embodiments may be performed in hardware, in software or both. For example, at least some of the operations in the hair-styling techniques may be implemented using program instructions 822, operating system 824 (such as a driver for interface circuit 818) or in firmware in interface circuit 818. Alternatively or additionally, at least some of the operations in the hair-styling techniques may be implemented in a physical layer, such as hardware in interface circuit 818.

In the preceding description, we refer to 'some embodiments.' Note that 'some embodiments' describes a subset of all of the possible embodiments, but does not always specify the same subset of embodiments. Moreover, note that numerical values in the preceding embodiments are illustrative examples of some embodiments. In other embodiments of the hair-styling techniques, different numerical values may be used.

The foregoing description is intended to enable any person skilled in the art to make and use the disclosure, and is provided in the context of a particular application and its requirements. Moreover, the foregoing descriptions of embodiments of the present disclosure have been presented for purposes of illustration and description only. They are not intended to be exhaustive or to limit the present disclosure to the forms disclosed. Accordingly, many modifications and variations will be apparent to practitioners skilled in the art, and the general principles defined herein may be applied to other embodiments and applications without departing from the spirit and scope of the present disclosure. Additionally, the discussion of the preceding embodiments is not intended to limit the present disclosure. Thus, the present disclosure is not intended to be limited to the embodiments shown, but is to be accorded the widest scope consistent with the principles and features disclosed herein.

What is claimed is:

1. A hair-styling tool, comprising:

a first pod configured to store a first liquid;

a second pod configured to store a second liquid, wherein the second pod is remateably coupled to the hair-styling tool;

a switch configured to selectively couple the first pod, the second pod, or both to a pump;

the pump, wherein, when selectively coupled to the first pod, the second pod, or both, the pump is configured to transfer the first liquid from the first pod to a heater, the second liquid from the second pod to the heater, or both;

the heater configured to convert the first liquid to a first gas and to output the first gas from openings in the hair-styling tool, convert the second liquid to a second gas and to output the second gas from the openings in the hair-styling tool, or both;

one or more sensors configured to monitor one or more of: the heating, the output of the first gas, or the output of the second gas; and a controller configured to control operation of the hair-styling tool based at least in part on a hair type of an individual and a type of the first liquid, a type of the second liquid, or both, wherein the first liquid comprises water and the second liquid comprises an oil type or an oil formulation; and wherein a composition corresponding to a combination of the first liquid and the second liquid is selected based at least in part on the hair type of the individual.

2. The hair-styling tool of claim 1, wherein the first pod is coupled to the hair-styling tool.

3. The hair-styling tool of claim 1, wherein the controller is configured to control operation of the hair-styling tool based at least in part on an issue associated with hair of the individual.

4. The hair-styling tool of claim 1, wherein the controller is configured to control operation of the hair-styling tool based at least in part on a flow setting of the hair-styling tool.

5. The hair-styling tool of claim 1, wherein the controller is configured to control operation of the hair-styling tool based at least in part on a predefined preference of the individual, a hair stylist, or both; and wherein the predefined preference comprises the oil formulation or the oil type of the first second liquid.

6. The hair-styling tool of claim 1, wherein the controller comprises a processor.

7. The hair-styling tool of claim 1, wherein the one or more sensors comprise: a hardware sensor, a software sensor, or both.

8. The hair-styling tool of claim 1, wherein the hair-styling tool comprises an interface circuit configured to wirelessly communicate with an electronic device; and wherein the hair-styling tool is configured to:

provide, addressed to the electronic device, data associated with operation of the hair-styling tool; and receive, associated with the electronic device, an update to a capability of the hair-styling tool or an additional capability of the hair-styling tool.

9. The hair-styling tool of claim 8, wherein the hair-styling tool is configured to receive, associated with the electronic device, information specifying the hair type.

10. The hair-styling tool of claim 1, wherein the one or more sensors comprise an environmental-monitoring sensor that is configured to determine an environmental condition in an environment of the hair-styling tool; and wherein the controller is configured to control operation of the hair-styling tool based at least in part on determined environmental conditions.

11. The hair-styling tool of claim 10, wherein the environmental condition comprises: temperature, humidity, or both.

12. The hair-styling tool of claim 1, wherein the hair-styling tool comprises a head, remateably coupled to the hair-styling tool, comprising multiple tines or prongs corresponding to the hair type and second openings coupled to the openings; and wherein the second openings are spatially proximate to the tines or prongs.

13. The hair-styling tool of claim 1, wherein controlling operation of the hair-styling tool comprises selecting a set of operating parameters associated with thermal management of the heater.

* * * * *